US012285090B2

(12) United States Patent
Hofer

(10) Patent No.: US 12,285,090 B2
(45) Date of Patent: Apr. 29, 2025

(54) FOLDING STICK

(71) Applicant: LEKISPORT AG, Baar (CH)

(72) Inventor: Marco Hofer, Unterbohringen (DE)

(73) Assignee: LEKISPORT AG, Baar (CH)

( * ) Notice: Subject to any disclaimer, the term of this patent is extended or adjusted under 35 U.S.C. 154(b) by 302 days.

(21) Appl. No.: 17/797,915

(22) PCT Filed: Feb. 2, 2021

(86) PCT No.: PCT/EP2021/052355
§ 371 (c)(1),
(2) Date: Aug. 5, 2022

(87) PCT Pub. No.: WO2021/156220
PCT Pub. Date: Aug. 12, 2021

(65) Prior Publication Data

US 2023/0128362 A1 Apr. 27, 2023

(30) Foreign Application Priority Data

Feb. 7, 2020 (CH) ..... 00140/20

(51) Int. Cl.
*A45B 9/00* (2006.01)

(52) U.S. Cl.
CPC ..... *A45B 9/00* (2013.01); *A45B 2009/007* (2013.01); *A45B 2200/055* (2013.01)

(58) Field of Classification Search
CPC ..... A45B 9/00; A45B 2009/005; A45B 2200/055
See application file for complete search history.

(56) References Cited

U.S. PATENT DOCUMENTS 2,705,015 A * 3/1955 Langlais ..... F16M 11/38 138/148
6,250,839 B1 6/2001 Lenhart
(Continued)

FOREIGN PATENT DOCUMENTS

DE 694 01 765 T2 10/1997
DE 297 06 849 U1 8/1998
(Continued)

OTHER PUBLICATIONS

International Search Report for PCT/EP2021/052355, dated Apr. 12, 2021.

*Primary Examiner* — Noah Chandler Hawk
(74) *Attorney, Agent, or Firm* — Sughrue Mion, PLLC

(57) ABSTRACT

A folding pole (1) having four or five tubular portions (7-9), wherein, in assembled state, the tubular portions (7-9) are connected to one another by plug-in connections and oriented along the pole axis (32), and, when the pole is folded up, at least two or three tubular portions (8, 8', 9) are connected only by a movable connecting element (16). The folding pole is characterized in that a conical closure plug (18) having an axial through-opening (64) is releasably inserted, preferably screwed, into the plug region (49, 17") of the plug-in connections, and closes off the latter with respect to the following tubular portion, and wherein each of these conical closure plugs (18) has an axial slit (63) through which the pull cable (16) can be introduced into the through-opening (64) in the radial direction.

24 Claims, 10 Drawing Sheets

(56) References Cited

U.S. PATENT DOCUMENTS

| | | | | |
|---|---|---|---|---|
| 8,006,711 | B2 * | 8/2011 | Pietrzak | A45B 9/00 135/65 |
| 8,496,018 | B2 * | 7/2013 | Lenhart | A63C 11/221 280/823 |
| 8,985,130 | B2 * | 3/2015 | Howarth | A45B 9/00 135/120.3 |
| 9,198,488 | B2 * | 12/2015 | Pronzati | A45B 9/00 |
| 11,071,362 | B2 * | 7/2021 | Lai | A45B 9/04 |
| 2010/0122718 | A1 * | 5/2010 | Lah | A45B 9/00 135/75 |
| 2012/0305041 | A1 * | 12/2012 | Lah | A45B 9/00 135/75 |
| 2014/0069475 | A1 * | 3/2014 | Lenhart | A45B 9/04 135/74 |
| 2017/0027290 | A1 * | 2/2017 | Heim | A45B 9/00 |
| 2020/0179776 | A1 * | 6/2020 | Roiser | A63C 11/22 |
| 2020/0276074 | A1 * | 9/2020 | McAteer | A61H 3/0277 |

FOREIGN PATENT DOCUMENTS

| | | | |
|---|---|---|---|
| DE | 297 08 829 | U1 | 9/1998 |
| DE | 102 15 593 | A1 | 10/2003 |
| DE | 10 2007 051 197 | A1 | 4/2009 |
| EP | 0 098 898 | A1 | 1/1984 |
| EP | 1 016 435 | A2 | 7/2000 |
| EP | 1 217 224 | A1 | 6/2002 |
| EP | 1 450 906 | A1 | 9/2004 |
| WO | 2006/066423 | A1 | 6/2006 |
| WO | 2006/066424 | A1 | 6/2006 |
| WO | 2008/037098 | A1 | 4/2008 |
| WO | 2010/085905 | A1 | 8/2010 |
| WO | 2012/104424 | A1 | 8/2012 |
| WO | 2018/224417 | A1 | 12/2018 |
| WO | 2019/129484 | A1 | 7/2019 |

* cited by examiner

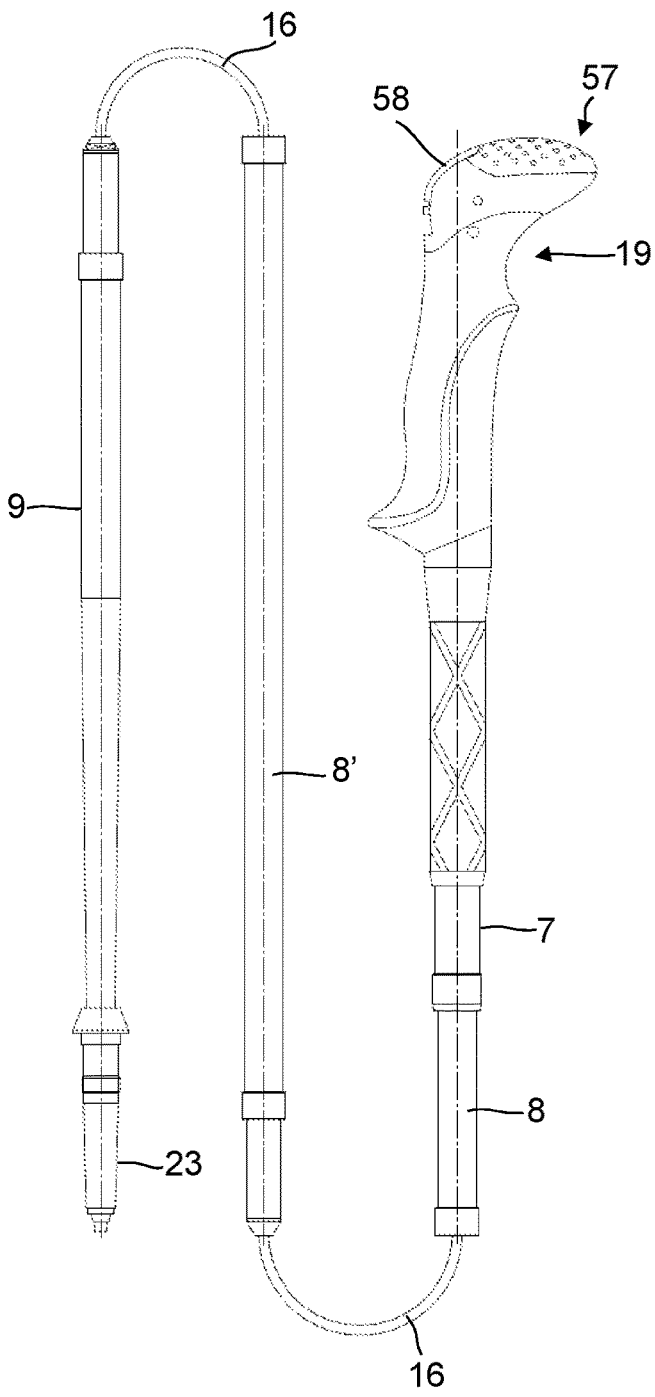
FIG. 3
FIG. 4a)
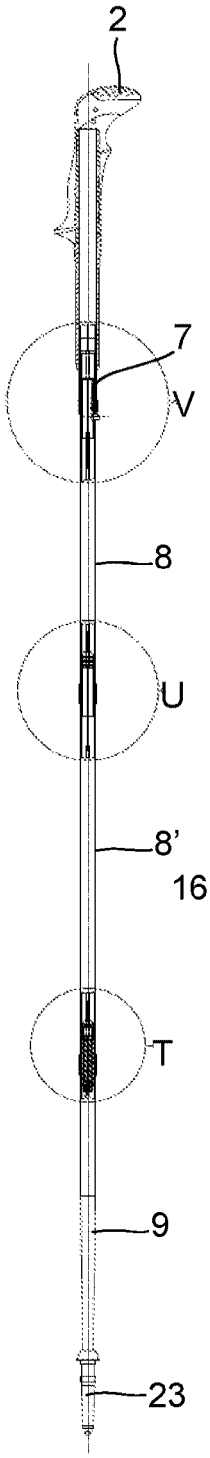
FIG. 4b)
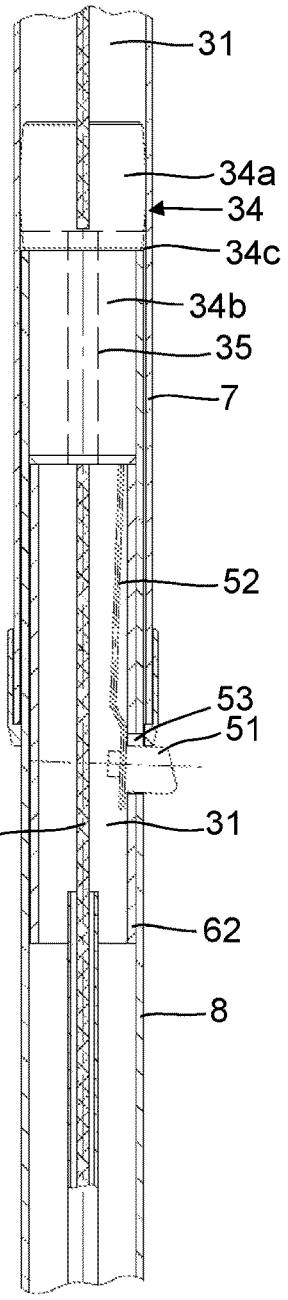

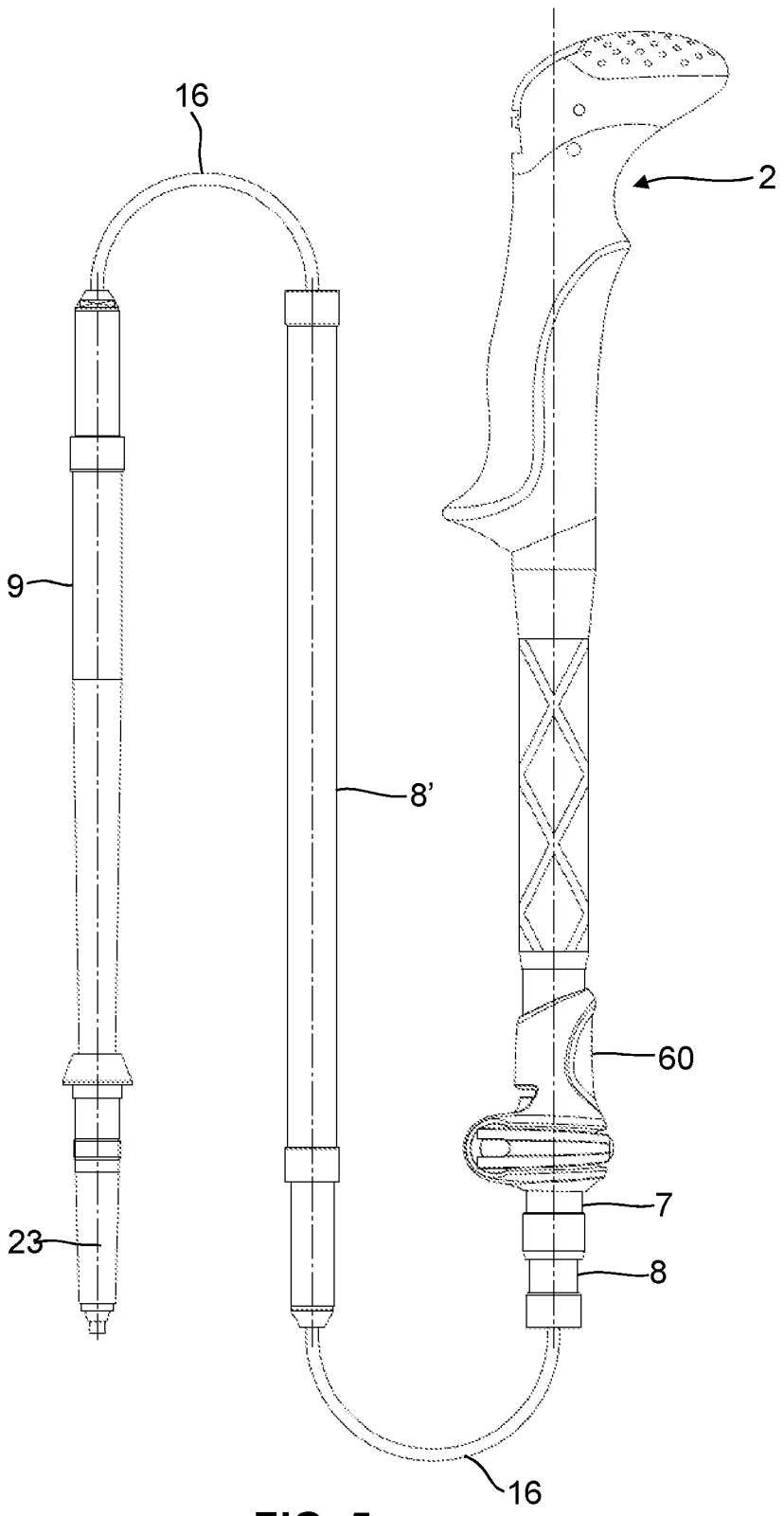
FIG. 5
FIG. 6a)
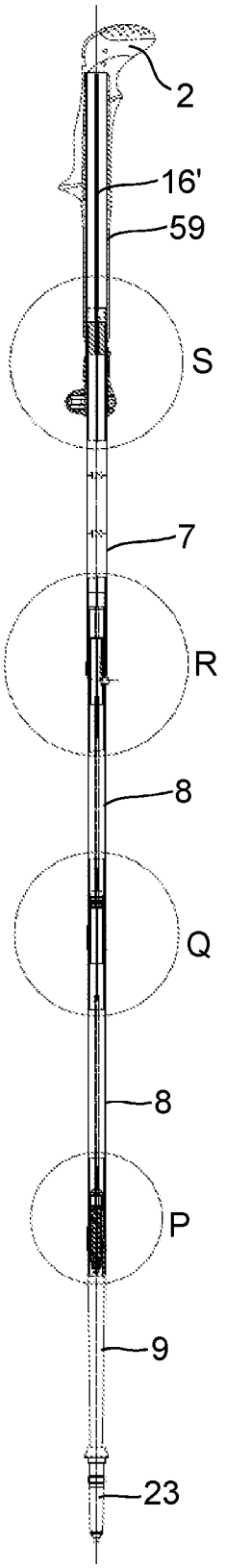

FOLDING STICK

CROSS REFERENCE TO RELATED APPLICATIONS

This application is a National Stage of Application No. PCT/EP2021/052355 filed Feb. 2, 2021, claiming priority based on Switzerland Patent Application No. 00140/20 filed Feb. 7, 2020.

TECHNICAL FIELD

The present invention relates to the field of poles used for hiking, and Nordic walking but also, in the broadest sense, for other types of sport such as, for example, cross-county skiing or alpine skiing, alpinism, etc.

PRIOR ART

In particular, but not exclusively, the field of hiking or Nordic walking is known to have pole designs which are adjustable in their length. The adjustment capability can be used, on the one hand, so that the length of the pole can be adjusted in line with requirements, but also, on the other hand, so that the pole can be reduced to the smallest possible packing size, i.e. the length can be configured for reduction to such a pronounced extent that the pole can be stowed, for example, in a backpack or similar. Such designs in which so-called inner tubes of small diameter are mounted in a displaceable manner in an outer tube of a somewhat larger diameter, and in which the relative position of the tube portions can be secured by an arresting mechanism, are known, for example, from DE 297 06 849 or else also from DE 297 08 829 or EP 1 450 906.

With use being made of such designs, it is imperative for the individual tube portions to have different diameters and, in addition, it has to be ensured, so that in particular the small packing size can be achieved, that the tubes can also actually be displaced largely one inside the other.

It can thus end up being the case that in particular in the lower region, where typically the thinnest tube is arranged, the pole becomes very thin and therefore no longer has a sufficient level of inherent rigidity for a number of applications; in addition, the designs disclosed in the documents above are often not looked upon so positively by the user since the relative position of the individual pole-tube portions has to be ensured by these pole-tube portions being rotated relative to one another, for which purpose it is necessary for corresponding rotary forces to be applied manually.

Alternative mechanisms, in which the axial position of different tube portions relative to one another is not secured by an internal arresting mechanism, are known, for example, from WO 2010/085905 or else also from DE 694 01 765 or EP 1 217 224 or EP 098 898; however, these external designs are often not suitable for mounting more than two pole tubes in a displaceable manner one insider the other, and this can also then result in the packing size not being sufficiently small.

There are so-called folding poles, for example known from WO 2012/104424, and in these individual pole segments are connected via plug-fit connections. The pole segments in this case can have essentially the same diameter, and the pole segments are connected to one another via a pull cable so that, once fitted together, the individual pole segments the segments are connected rigidly to one another as a result of this pull cable being subjected to tension. The problem of these designs is that the flexible pull cable has to connect the individual pole segments to one another and run through these segments. This means that such designs are not straightforward to produce and service and are also difficult to put together in accordance with different customer requirements.

DESCRIPTION OF THE INVENTION

This is where the present invention comes in. It is the object of the present invention to provide a folding pole which is improved in particular in respect of modularity, simplicity in relation to assembly, simplicity in relation to alteration and simplicity in relation to repair or changeover of parts.

This object is achieved by a folding pole as claimed in the claims.

In specific terms, the present invention relates to a folding pole having at least three or having at least four, or preferably five, tube portions, wherein, in the assembled state of the folding pole, the tube portions are connected rigidly to one another so as to be oriented along the pole axis via plug-fit connections, and, in the collapsed state, at least two or at least three tube portions are connected to one another just via a movable connecting element, and wherein a pole handle is arranged on an uppermost tube portion and a pole tip is arranged on a lowermost tube portion.

At least one of the plug-fit connections here is realized via an external clamping mechanism and/or a form-fitting latching device.

It is also possible for one connection to be designed in the form of an external clamping mechanism, e.g. having a lever, and for a further connection to be designed in the form of a form-fitting latching device (arranged on the outside or inside), in which case the external clamping mechanism is preferably provided closer to the handle or on the tube portion on which the pole handle is arranged, and the connection made up of the form-fitting latching device follows in the downward direction.

The clamping mechanism is fastened on a first tube portion, and a second tube portion, which has an external diameter smaller than or more or less equal to the internal diameter of the first tube portion and which is mounted in a displaceable manner per se in the first tube portion, can be fixed in the relative axial position by the external clamping mechanism.

The alternative or additional form-fitting latching device is realized on a second tube portion, wherein the second tube portion has an external diameter smaller than or more or less equal to the internal diameter of a first tube portion, and it can be pushed into the first tube portion and fixed in the relative axial position by the form-fitting latching device.

The further plug-fit connections here are designed in the form of straightforward plug-fit connections in which, in the fitted-together state, tube portions are fixed only in one axial direction, provided they are not held together by the pull cable.

The tube portions are connected to one another via at least one pull cable, which is fastened on the lowermost tube portion and on the uppermost tube portion and is arranged so as to run through the interior space of the at least two or three central tube portions.

The folding pole is designed such that it can be moved or transferred from the collapsed state to the assembled state by the (further) plug-fit connections being fitted together or sliding one inside the other by the continuous bracing of the pull cable, and then, with the external clamping mechanism released or with the latching device released, by the second tube portion being pulled out of the first tube portion to the extent where the pull cable is braced, and by the external clamping mechanism or the form-fitting latching device being fixed. This means that the further plug-fit connections are then fixed in both axial directions. Possible latching devices used come in different designs, for example those which are disclosed in WO 2018/224417 and have an external rocker, but also those which are described in WO 2019/129484 and are arranged on the inner side.

The latching device can preferably be constructed as follows: as a clamping device for the form-fitting releasable axial securing action of an inner-tube portion which can be pushed into an opening of the clamping device fastened on an outer tube, wherein the clamping device has an encircling plastic cuff, to the outside of which a clamping lever is attached, such that it can be tilted counter to the restoring force of a spring element, via an axial element which is arranged perpendicularly in relation to the pole axis, wherein the plastic cuff has two protrusions with through-passage openings and/or apertures for the axial element, and the clamping lever is mounted between these protrusions such that it can be tilted about the axial element, and wherein the plastic cuff has a radial through-opening, wherein the clamping lever has a first lever arm with an externally accessible pressure-exerting region for releasing the clamping device and a second lever arm, which is arranged on the other side of the axial element, wherein the second lever arm has a clamping protrusion which is arranged essentially radially in relation to the pole axis, engages through the radial through-opening in the plastic cuff into an axial through-opening of the plastic cuff and engages in a form-fitting manner in a groove or aperture of the inner tube, or of a guide insert connected to the inner tube, in order for the two tubes to be secured axially. However, it is also possible for the inner tube to be clamped in the outer tube by a different technical solution to that described above.

The further plug-fit connections or at least one of these is/are designed so as to have, on the one tube portion, a guide stub which is provided with an axially running, central through-opening for the pull cable, is firmly fastened in said tube portion by way of a fastening portion and, axially opposite, has a stub region which is exposed in the folded state of the pole and can be pushed into the other tube portion, wherein the fastening portion and stub region have a through-opening for the pull cable.

In the stub region so as to close the latter off in relation to the following tube section, there is then, for each plug-fit connection, a conical terminating stub with an axial through-opening for the pull cable. The conical terminating stub is fastened in a releasable manner, e.g. screwed in or latched in, in the stub region and each conical terminating stub, or at least one of these conical terminating stubs, has an axial slot, by way of which the pull cable can be introduced into the through-opening in the radial direction.

The axial slot for the introduction of the pull cable into the through-opening in the radial direction is in an exposed state or can be exposed or opened when the conical terminating stub is removed from the stub region.

The axial slot of the conical terminating stub can be designed in different ways. Typically, the conical terminating stub is formed in one piece. It is then possible for the conical terminating stub either, as a rigid component, to have an axial slot which is of essentially predefined width and through which the pull cable can be introduced into the through-opening in the radial direction when the conical terminating stub has been removed from the stub region.

As an alternative or in addition, it is also possible for the conical terminating stub, as a flexible component, to have an axial slot which is variable in width and for the introduction of the pull cable into the through-opening in the radial direction, in the state in which it has been released from the stub region, is preferably widened counter to a certain restoring force.

However, it is also possible for the axial slot to be provided by the conical terminating stub, as a flexible component, having two conical-terminating-stub halves connected via preferably a film hinge, wherein the film hinge connects the two conical-terminating-stub halves only on one side of the through-opening. It is also possible for such a conical-terminating-stub component to be formed in two parts, i.e. without a film hinge, although it should then be ensured that there are positioning aids provided to orient the two halves precisely relative to one another in the assembled state, which is important, in particular, when an external thread is provided for fastening purposes in the guide stub. The conical-terminating-stub halves here are preferably of essentially symmetrical design and are defined by a central axial separating surface. Such a conical terminating stub can be removed from the stub region (for example by being unscrewed) and can then be swung open to a certain extent via the film hinge to expose the axial slot. It is not necessary, however, for the conical terminating stub to be swung open completely; it is sufficient for the two halves to be widened to some extent in the vicinity of the axial slot in order for the latter to be opened for the introduction of the pull cable. The film hinge here is preferably provided on an axial end surface of the conical terminating stub. In the mounted/screwed-in state of the conical terminating stub, the axial slot assumes a parallel spacing of 0 or, in sub-regions of the thread, even smaller. It is thus possible for example for force-fitting bracing to be transferred to the final thread turns and therefore for an undesired unscrewing action of the terminating stub to be prevented. It is normally the case with the film-hinge variant that the abutment surfaces butt in a parallel state against one another (that is to say the slot is barely open when the stub is in the mounted state, but is capable of being opened when the stub has been removed). If the abutment surfaces run slightly conically in relation to one another, it is possible (since the surfaces butt in a parallel state against one another during the mounting operation) for a securing action to be achieved, in addition, via a slight increase in the external diameter. Of course, it is also possible for this to occur when the surfaces remain parallel to one another and the external thread of the terminating stub is increased (in sub-regions).

Releasable here, in particular in relation to the conical terminating stub, should be understood to mean that the conical terminating stub can be separated off in a non-destructive manner, possibly with the aid of a tool and in a reversible manner, without any need to release a strong material bond (with the exception of, for example, a releasable thread-locking fluid or the like) such as, for example, adhesive bonding; e.g. the conical terminating stub can be unscrewed or released by a latching connection, and it can also be screwed or latched in again.

By virtue of the proposed design with the conical terminating stubs, which can be unscrewed or removed by the release of a latching connection and have, or provide, an axially running lateral slot, through which the pull cable can be inserted into, and removed from, the through-opening, it is possible for such a folding pole to be readily taken apart in a reversible manner without the pull cable being destroyed. For this purpose, it is possible, following release of the plug-fit connections, in a first step for the lowermost conical terminating stub to be unscrewed or, by release of the latching connection, separated and then for the pull cable to be pulled out of the lowermost tube portion, possibly along with the spring fastened thereon. This frees the lowermost tube portion. The conical terminating stub of the lowermost tube portion can then be removed from the pull cable with the aid of the slot of the stub. If the conical terminating stub of the next-following tube portion is then unscrewed or, by release of the latching connection, removed, then it is possible, in turn, for the conical terminating stub, on account of its axial slot, to be separated from the cable, and the cable to be pulled through this further, following tube portion. This also then frees the second-from-bottom tube portion and allows the latter to be, for example, replaced or changed over for another design. The lateral slot of the conical terminating stub can be configured such that the pull cable can be latched into the through-opening of the conical terminating stub, or unlatched from the same, with a slight resistance, or, as described above, it is also possible for it to be realized via a film hinge, by means of which two conical-terminating-stub halves separated more or less in the axial direction are connected on only one side of the through-opening.

The conical terminating stub is preferably produced in the form of an injection-molded component, for example made of a thermoplastic material. Examples of possible materials are polyamide, polyethylene, polypropylene, polycarbonate, polyurethane and also mixtures or glass-fiber-reinforce variants thereof.

It is equally possible for the stub region to consist of such a material; however, the stub region can also be produced from metal. If an internal thread has to be provided in the stub region, because the conical terminating stub is to be screwed into such a thread, then this internal thread either can be provided directly in the stub region or it is also possible to provide a separate internal-thread insert, made of plastic or metal, which is inserted into the stub region and fastened therein, preferably by adhesive bonding and/or pressing.

A first preferred embodiment is characterized in that each conical terminating stub has a conically tapering region which is exposed when the pole is in the folded state, and this conically tapering region contains means via which the conical terminating stub can be gripped and screwed in or unscrewed or made to establish a latching connection or released from a latching connection. These means are preferably designed in the form of at least two, or precisely two, in particular oppositely located notches, steps or shoulders (e.g. also milled recesses), which preferably have mutually parallel surfaces forming planes at a tangent to the axis of the pole.

These means can be designed in the form of precisely two oppositely located steps or notches, which have mutually parallel surfaces which form planes at a tangent to the axis of the pole, wherein these surfaces run parallel to the direction in which the axial slot runs. It is thus possible, for example using a customary open-end wrench, for the respective conical terminating stub to be readily unscrewed and screwed in again or to be made to establish a latching connection or be released therefrom.

A further preferred embodiment is characterized in that the two or three lowermost tube portions are connected to one another via the aforementioned further plug-fit connections, and in that the subsequent or the uppermost of the three tube portions has a terminating stub (with a through-opening for the pull cable, wherein the pull cable runs freely in this opening and is not fastened) at its upper end, wherein this terminating stub has a head region, which projects upward out of the tube portion, and a neck region, by way of which the terminating stub is firmly fastened in the tube portion, and wherein the head region and neck region are designed in the form of two separate components which can be screwed or latched in in a releasable manner one inside the other. This design further increases the service-friendliness since it is then also possible for the subsequent or uppermost tube portion to be removed and separated from the pull cable by the lower two tube portions, as described above, being separated from the cable, by the head region of the terminating stub being, for example, unscrewed, and then by the cable likewise being straightforwardly pulled through this further tube portion. It is also possible in this way for the third tube portion (or, if there are four portions with three straightforward plug-fit connections, the fourth tube portion), as seen from below, to be separated off.

A further preferred embodiment is characterized in that an uppermost terminating stub is provided in the first tube portion, and the pull cable is fastened in this uppermost terminating stub in such a manner that, when it is not braced, it can be pulled upward out of the uppermost terminating stub. In particular, preferably, this is achieved by virtue of the uppermost terminating stub containing at least one stepped through-opening, with a tapering in the lower region, and wherein the pull cable is preferably caught in this step by way of a knot or preferably a crimp. This design yet further increases the service-friendliness since it is then also possible for the pull cable, when it is not braced, to be pulled upward out of the uppermost terminating stub. Here too, it is possible for the head region of the uppermost terminating stub and the neck region of the latter to be designed in the form of two separate components which can be screwed in a releasable manner one inside the other.

Above the first tube portion there can be a (yet) further tube portion, into which the first tube portion can be pushed in a displaceable manner and can be secured axially in various positions by way of an external clamping mechanism, wherein the uppermost terminating stub is connected to this further tube portion by way of a further pull cable, so that, when the external clamping mechanism is released, the first tube portion cannot be pulled out of the further tube portion.

The further pull cable is then preferably fastened in a releasable manner at the upper end of the further tube portion or on a handle fastened thereon, preferably so as to be free of rotation, wherein the fastening of the further pull cable can preferably be released, possibly once a cover of the handle has been removed, by the fastening of this further pull cable being freed from the outside in a non-destructive manner, for example via a hook connection.

The pole is preferably one having three lower tube segments, which are connected to one another via two straightforward plug-fit connections, and a fourth tube segment, which follows the three lower tube segments and in which the third tube segment engages with sliding action, and wherein the pull cable is braced by the axial relative position between the third and fourth tube segments being set to a maximum, to achieve bracing of the pull cable. For this purpose, a clamping mechanism with a form fit is preferably provided between the third and fourth tube segments. There is then preferably also a fifth, uppermost tube segment, the latter having an internal diameter which is again somewhat larger than the external diameter of the fourth tube, and the fourth tube is mounted for sliding action in this fifth tube segment, on which the pole handle is also fastened. The relative position in the axial direction between the fourth and fifth tube segments can be fastened in a variable manner, for example via an external clamping mechanism, for example with a lever, as has been described above and also will be described in detail hereinbelow. However, it is also possible for the clamping mechanism to be an internal one.

The fastening of the pull cable on the holder element (which is lowermost, i.e. fastened on the lowermost tube portion) can be of elastically sprung design, preferably by a (helical or elastomer) spring being provided on the holder element of the lowermost tube portion, the pull cable being arranged so as to run through the interior space of the spring. It is preferably the case that at least certain parts of the pull cable are, in particular preferably the entire length of the pull cable in the longitudinal direction is, of tension-resistant and inelastic design. The helical spring preferably has an external diameter such that it can be pulled through the through-openings of the guide stubs, minus conical terminating stub, and through the terminating stub, minus head region.

The pull cable preferably consists of a flexible, longitudinally tension-resistant and non-elastic material, and is preferably provided with a plastic coating or encapsulated in a plastic. The specific configuration of the conical terminating stub with the axial slot now renders the prior-art sheathing of the pull cable with a separate hose unnecessary and even disadvantageous; such a pull cable with a plastic coating, or encapsulated in a plastic layer, can optimally be guided within the pole and perform its function, but also be guided through the conical terminating stub or the slots thereof.

A further preferred embodiment here is characterized in that the first tube portion is the uppermost tube portion, and in that the second tube portion is the first central tube portion, which adjoins the aforementioned tube portion in the downward direction. This allows for particularly straightforward handling; in addition, this design then typically has the uppermost tube portion as that with the largest diameter and has the clamping mechanism far up, which then also results in an ideal weight distribution along the pole axis. In the case of a form-fitting latching device for bracing the cable, the first tube portion is preferably the uppermost or second-from-top tube portion, and the second tube portion is the first central tube portion, which adjoins the aforementioned tube portion in the downward direction. The latching device has, for example, a spring-loaded radial latching pin, which is preferably retained in a radial through-bore of the second tube portion so as to project through the bore counter to the action of a spring. The spring element is preferably a leaf spring, e.g. a spring plate, to the first end of which the latching pin is advantageously fastened, e.g. by riveting. The second end of the leaf spring here preferably projects with self-locking action into a terminating-stub channel arranged along the longitudinal axis of the pole. The self-locking action is achieved, for example, by means of barbs, which, in the case of a spring plate, are arranged at the second end of the latter. The terminating stub is preferably retained in the upper portion of the second tube portion. According to a particularly preferred embodiment, the terminating stub is pushed into the first tube portion, and fastened, by way of its head and has a collar, which rests on the upper end of the second tube portion. The terminating-stub neck, which adjoins the collar at the bottom, is preferably pushed into the second tube portion in the region of overlap between the first and second tube portions.

A further preferred embodiment is characterized in that the further plug-fit connections are designed such that, in the axial stop position, they are secured against the thereby connected tube portions rotating relative to one another about the pole axis, preferably by ensuring the presence of a form-fitting connection which secures against rotation and also preferably locks automatically when the plug-fit connections are pushed together axially. This is important, in particular, when for example the pole tip and the pole handle are both of asymmetrical design, i.e. are each designed in a specific manner in the walking direction. A further preferred embodiment is characterized in that the tube portions are dimensioned (in particular in respect of length, but also in particular in respect of the possible depth to which the second-from-top tube portion is fitted into the uppermost tube portion) such that, when the pole is in the assembled state, the uppermost central tube portion can be pushed essentially all the way into the uppermost tube portion, or can be pushed into the same so that only a short portion remains jutting out. This gives rise, in the collapsed state, to a situation in which, for a folding pole having four tube portions, the uppermost two tube portions are pushed more or less fully one inside the other and the lower two tube portions can be connected to one another loosely and only via the pull cable and, in addition, can be arranged to a certain extent in zigzag fashion. This gives rise to a minimal packing size. According to a particularly preferred embodiment, the closure element here, which is preferably formed from plastic, has a head portion and a neck portion, wherein the neck portion can preferably be fitted into the upper end of the holder element, can be screwed into the same by means of an externally threaded bore, or can be fitted therein, and latched with rotary action, by a bayonet closure. For this purpose, the holder element preferably has an internally threaded bore in its upper region. According to a particularly preferred embodiment, the closure element here is arranged axially above the helical spring. A guide element is preferably arranged, as a stop element, between the helical spring and closure element, and this guide element or stop element has a radial flange resting on the helical spring and an axial guide portion projecting into the helical spring. The radial flange of the stop element here serves as a clear stop surface or bearing surface for the closure element. The lower cable attachment means, i.e. the pull cable, which is knotted or crimped at the bottom, together with guide elements, helical spring and closure element, thus constitute a unit which is easy for the user to remove from the pole tube. In order to change over the cable, the user releases the closure element from the holder element, removes said unit and possibly releases the knot or crimp at the lower end of the pull cable (it is not absolutely necessary to release the knot or crimp since the cable unit can be removed in its entirety). It is thus possible for the cable to be pulled out from the top, preferably through the handle head. A further preferred embodiment of the folding pole proposed here is characterized in that the further plug-fit connections are designed so as to have, on the one tube portion, a guide stub (preferably in one piece and consisting of plastic) which is provided with an axially running, central through-opening for the pull cable, is firmly fastened in said tube portion by way of a fastening portion and, axially opposite, has a stub region which can be pushed into the other tube portion, wherein a preferably radially encircling, outwardly directed bearing flange is provided between the fastening portion and stub region and, in the fitted-together state, the bearing flange is made to stop axially against the tube end of the other tube portion and/or against a tube-terminating cuff provided thereon, wherein this axial stop function is preferably formed asymmetrically about the pole axis, and/or wherein the stub region further preferably has an at least partially conically tapering region at its end which is directed toward the other tube portion.

In general terms, the pole handle can preferably be one which has, for example, a hook-like device for fastening a hand-hold device in particular in the form of a hand loop or of a glove, wherein displaceable or rotatable latch-in means are arranged in the region of the hook-like device such that a loop-form, ring-form or eyelet-form device, which is provided on the hand-hold device is pushed into the hook-like device essentially from above, is fixed with self-latching action in the hook-like device, wherein the hook-like device is preferably arranged on the hand side in the upper region of the pole handle, and wherein the hook-like device further preferably comprises a retaining spike or retaining pin, which is preferably arranged essentially parallel to the pole axis, is offset from the handle body toward the hand side, an introduction slot being formed in the process, or is arranged in the form of an incision in the handle body, wherein the depth of the introduction slot is preferably greater than the width and the thickness of the retaining spike or retaining pin. In specific terms, in other words, the pole handle is in particular preferably one as disclosed in WO 2006/066423. As far as the pole handle is concerned, the disclosure of said document is expressly included in the disclosure content of this present document.

According to a further preferred embodiment, the pole handle is of ergonomic design, for example as is disclosed in EP 2 168 641. According to a particularly advantageous embodiment, the pole handle has a removable cover on its handle head.

At its lower end, the handle head preferably has an axial through-bore, through which the upper end of the pull cable projects into the handle head. The upper cable-attachment means can be configured, for example, in that the upper end of the pull cable is knotted or crimped. Removal of the cover allows the user to access the upper end of the pull cable and pull the pull cable out of the pole, without the pole handle having to be removed (e.g. disengaged from swivel hooks), and to pull the bearing element, along with the pull cable engaged in the hook therein, out of the pole. According to a further preferred embodiment, the pole tip comprises a tip body and a buffer, wherein the tip body and/or the lowermost portion of the pole body are arranged so as to pass through a central opening of the buffer, and wherein the buffer in a is displaceably mounted such that it can be arrested in an axial direction in relation to the pole body in said central opening, and wherein the buffer can be secured in at least two axially different positions in relation to the pole body via a form-fitting connection, wherein the tip body preferably has a latching track, in which latching track a latching body which is mounted in the buffer can engage in a form-fitting manner in order to secure the axial position, the latching body being pivotably and/or displaceably and/or firmly mounted in or on the buffer, and wherein the latching body is in particular preferably designed in the form of a latching lever which is articulated on the outside, wherein the latching lever has its lower end, which is directed toward the asymmetric rolling surface of the buffer, articulated on the outer sleeve and has its upper end, in the arrested position of the buffer, gripping in an at least partially form-fitting manner around the pole tube and/or an inner sleeve and, for release purposes, the latching lever can be pivoted away from an outer sleeve. In specific terms, in other words, the pole tip can be one which is designed specifically for Nordic walking applications, for example one as is described in WO 2008/037098. As far as the design of the pole tip is concerned, the disclosure of said document is expressly included in the disclosure content of this present application.

A further preferred embodiment of such a folding pole is characterized in that, in the case of an external clamping mechanism, the external clamping device comprises a plastic cuff which essentially directly grips around at least one axial portion of the tube portion and, in the closed state, clamps the same, wherein the plastic cuff, at least in the region which grips the tube portion, has at least one axial slot, which renders the circumference of the plastic cuff variable in this region, and, in the remaining axial region, is of essentially encircling design, wherein a respective protrusion is arranged on the plastic cuff on either side of said slot, wherein these protrusions have a coaxial through-passage opening which is arranged essentially perpendicularly in relation to the axis of the tube portion and through which a transverse pin engages, the transverse pin having a stop on the outer side of the second protrusion and, on the outer side of the first protrusion, having an axis of rotation for a clamping lever, this axis of rotation being arranged perpendicularly in relation to the axis of the transverse pin and parallel to the axis of the tube portion, wherein the clamping lever has a lever arm which, when the clamping device is closed, at least partially grips around the plastic cuff, and wherein the clamping lever has a rolling region, which runs eccentrically around the axis of rotation and by means of which it is possible to reduce the spacing between the stop and a mating surface, arranged on the outer side of the first protrusion, for clamping purposes by virtue of the clamping lever being pivoted into the closed position, wherein the mating surface is preferably designed in the form of a metal element, at least part of which is arranged in a depression in the first protrusion, and wherein the mating surface is further preferably designed in the form of a planar surface or in the form of a concave surface, the radius of curvature of which is essentially adapted to the radius of curvature of the rolling region, and wherein the plastic cuff further preferably has at least two, preferably at least three, axially running slots in its upper portion, wherein at least one of these slots is arranged between the two protrusions and these slots are preferably distributed uniformly around the circumference, and/or wherein the aforementioned stop is further preferably of adjustable design, wherein the stop is preferably formed with a thread and the transverse pin is formed with a mating thread, and the stop is designed in the form of a nut or screw, preferably with an encircling toothing formation and/or a tongue and/or a groove for the engagement of an adjusting tool. In other words, the clamping mechanism can preferably be one as is disclosed, for example, in WO 2010/085905. As far as the clamping mechanism is concerned, the disclosure of said document is expressly included in the disclosure content of this present application.

If, for cable-bracing purposes, the folding pole has a form-fitting latching device instead of an external clamping mechanism, then the pole can be configured in a length-adjustable manner throughout. The length-adjustable mechanism here can be an external clamping mechanism which acts in a force-fitting manner, as described in the preceding paragraph. The clamping mechanism is preferably used for telescopic length adjustment of the second tube portion and, for this purpose, is fastened on the first tube portion. It is preferably the case that the lower central tube portion is of length-adjustable configuration. If the folding pole is of length-adjustable configuration, then it preferably has an additional tube portion, preferably adjoining the first tube portion at the top, on which the pole handle is fastened, wherein the external clamping mechanism is fastened on the uppermost tube portion.

The pole tube is preferably configured essentially from aluminum or carbon, wherein, in the case of a carbon design, the transition regions between individual tube portions are reinforced by means of stabilizing sleeves, for example made of aluminum. Further embodiments are specified in the dependent claims.

BRIEF DESCRIPTION OF THE DRAWINGS

Preferred embodiments of the invention will be described hereinbelow with reference to the drawings, which serve merely for explanatory purposes and should not be interpreted as being restrictive. In the drawings:

FIG. 3 shows a view of a second embodiment of a pole in the folded state, wherein, for cable-bracing purposes, the pole has a form-fitting latching device instead of an external clamping mechanism;

FIGS. 4*a*-4*d* show, in FIG. 4*a*), an axial section through a folding pole according to FIG. 3 in the fitted-together state and, in FIG. 4*b*), a section through the region of the latching mechanism between the first and the second tube portions according to V, the latching mechanism serving for cable-bracing purposes, and, in FIG. 4*c*), the view according to U as illustrated in FIG. 4*a*) and, in FIG. 4*d*), the view according to T as illustrated in FIG. 4*a*);

FIG. 5 shows a view of a third embodiment of a pole in the folded state, wherein, for cable-bracing purposes, the pole has a form-fitting latching device and, for length-adjustment purposes, it has an external clamping mechanism;

FIGS. 6*a*-6*e* show, in FIG. 6*a*), an axial section through a folding pole according to FIG. 5 in the fitted-together state and, in FIG. 6*b*), a section through the region of the length-adjustment region of the external clamping mechanism and the region of the upper cable-attachment means and, in FIG. 6*c*), the view according to R as illustrated in FIG. 6*a*) and, in FIG. 6*d*), the view according to Q as illustrated in FIG. 6*a*) and, in FIG. 6*e*), the view according to P as illustrated in FIG. 6*a*);

DESCRIPTION OF PREFERRED EMBODIMENTS

Figure 1:
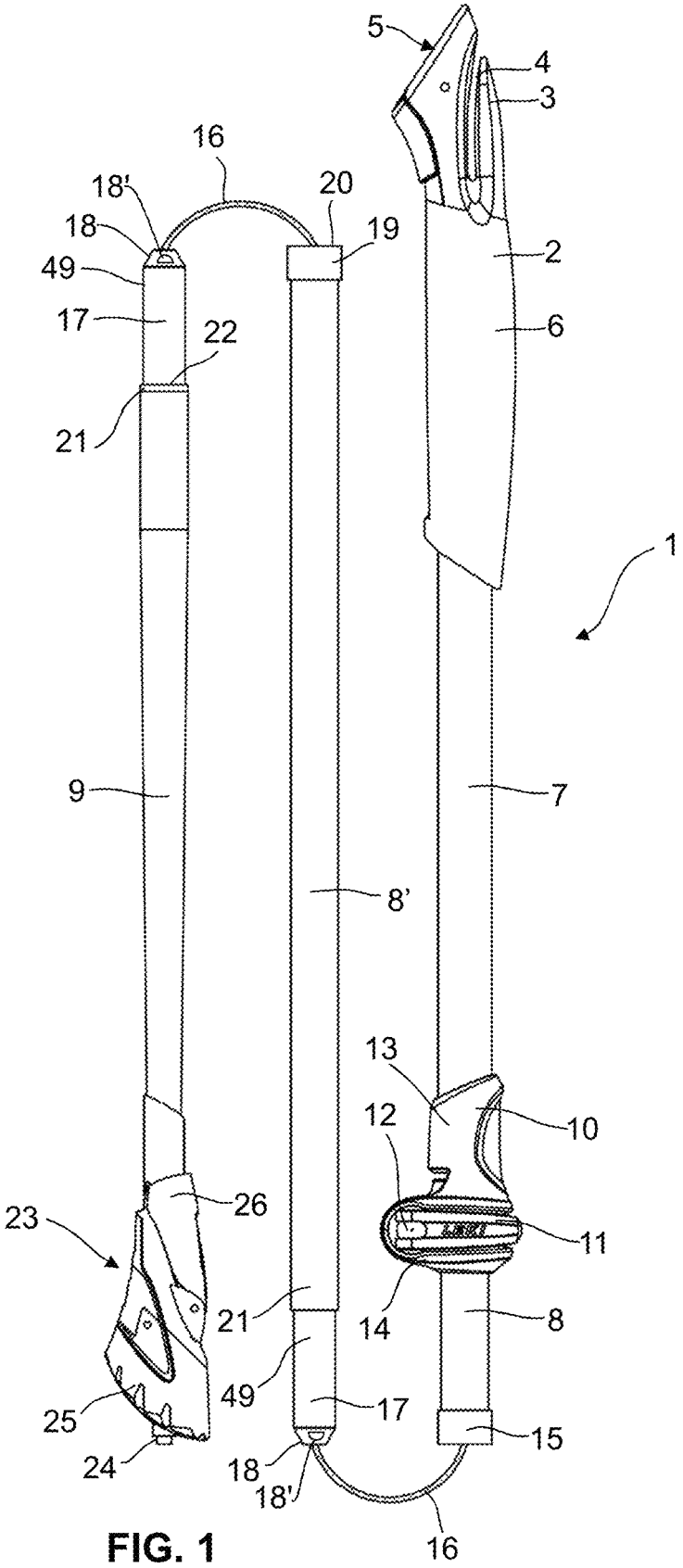
FIG. 1 shows a view of a pole having four tube portions in the folded state, wherein the lower two tube portions are arranged loosely and so as to be connected just via the pull cable and the two upper tube portions are pushed as far as possible one inside the other and are secured in their axial position relative to one another via the external clamping mechanism.
Figure 2:
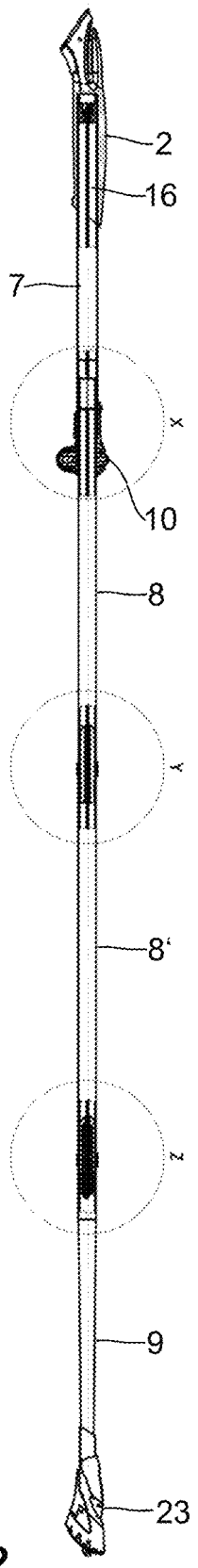
FIG. 2 shows an axial section through a folding pole according to FIG. 1 in the fitted-together state.

An exemplary embodiment of a folding pole 1 having four tube portions 7-9 is illustrated in FIGS. 1 and 2. FIG. 1 shows such a folding pole 1 in the collapsed state, i.e. in the state in which the uppermost two tube portions are pushed fully one inside the other and the lower two tube portions are arranged in a folded manner alongside the same, and FIG. 2 shows the folding pole in the fitted-together state.

In specific terms, such a pole comprises an uppermost tube portion 7, on which a pole handle 2 is fastened right at the top. In this case, this pole handle 2 is of asymmetric design; in the walking direction, to the front, it is beveled right at the top and has there a trigger knob 5 for a holder mechanism for a hand-hold device and, some way to the rear, has a retaining nose 3, which is designed in a form of a pin with a slot 4 arranged in front of the same. This is a pole handle as is known, for example, from WO 2006/066423 and as can be used, for example, together with a glove or a hand loop, as known from WO 2006/066424, i.e. with a hand-hold device which, between the thumb and index finger, has a loop which can be guided over the retaining nose 3 and then locked with self-latching action in the slot 4. The pole handle also has a grip region 6, which is usually designed in the form of a region with a grip-friendly coating.

An external clamping mechanism 10 is arranged at the lower end of said uppermost tube portion, the tube being able to be—and this applies to all the tube portions—basically a tube made of aluminum or carbon-composite material. In this specific case, the clamping mechanism is an external clamping mechanism as is known from WO 2010/085905, but it could also be a clamping mechanism according to EP 098 898 or according to EP 1 217 224.

In this specific case, the upper region of the clamping mechanism 10 is fastened on the tube portion 7 via an encircling retaining region 13, which typically consists of plastic, and, in the encased region, particularly beneath the retaining region 13, the upper tube portion 7 has an axially running slot, so that the actual clamping region of the cuff, this clamping region being arranged beneath the region 13, causes the outer tube 7 to be firmly clamped onto the inner tube 8, which has been pushed into this, and therefore a force-fitting connection can be established between the two. Accordingly, there is a slotted clamping region 14 beneath the encircling retaining region 13, wherein the slot runs between two protrusions, through which a transversely running pin, which forms an axial clamping element 12, passes. The pin is fixed on the rear side for example by a nut and, on the side which is illustrated here on the front side, it is connected to the lever 11 via a transverse axial element, which forms a point of rotation for the lever. At its fulcrum, the lever 11 has two fork-like widenings, designed in the form of eccentrics, so that the clamping lever 11 in the clamped-together state, as is illustrated here, when the lever has been swung around the pole tube or around the clamping device, the slot is tapered to such a pronounced extent that the clamping takes place, and that, when the lever is swung outward, this clamping is reduced because the eccentric widens the two protrusions to a certain extent and frees the clamping.

In the uppermost tube portion 7, the upper of the two central tube portions 8 has been pushed in from the inside. The external diameter of this upper central tube portion 8 therefore corresponds to just a bit less than the internal diameter of the uppermost tube portion 7, so that displacement capability is ensured, albeit with as little play as possible. The uppermost tube portion 7 here accommodates within it as much as possible of the upper of the central tube portions 8, so that the packing size is kept as small as possible. It is typical here for the tube portion 8 to be pushed in until it stops against an upper fastening stub 27.

The upper of the two central tube portions 8 is followed by a further, lower central tube portion 8', which has been folded over to some extent here and has the same tube diameter as the upper central tube portion 8. Provided therebetween is a plug-fit connection 17, which has not been connected here. The plug-fit connection 17 has a guide stub 49, which tapers conically 18 at its tip. The guide stub 49 is fastened on the lower of the two tube portions 8' and is pushed into the same via a fastening region 37; the other tube portion 8 typically has an upper tube-terminating cuff 15, inter alia for protecting the end of the tube, but also for rotation-fixing purposes (cf. below).

The conically tapering region 18 is designed in the form of a slotted conical terminating stub which is inserted in a releasable manner, preferably screwed or latched, into the cylindrical region of the plug-fit connection 17. For this purpose, the conical terminating stub 18, in the region which engages in the cylindrical region of the plug-fit connection 17, has an external thread or latch-in elements (e.g. protrusions) and the cylindrical region of the plug-fit connection 17, on the inner side there, has a corresponding internal thread or, in the case of a latchable clip connection, has apertures, for example in the form of oppositely located bores, into which elastically mounted and movable protrusions can latch. In order to facilitate screwing-in and unscrewing, the conical terminating stub 18, in the exposed, conically tapering region, has two axially oppositely located notches 18', of which the axially running flanks run parallel, so that a tool can be used to unscrew the conical terminating stub 18.

A lower tube-terminating cuff 19 is provided at the opposite end of the lower of the two central tube portions 8'. Again in a folded-over state, this is followed by the lowermost tube portion 9, which in this case is a butted tube, which in the uppermost portion has the same diameter as the two central tube portions 8, 8', but tapers downwards.

A pole tip 23 is fastened at the lower end of said lowermost tube portion 9, and this pole tip is of asymmetrical design, i.e., in the lowermost region, it has a beveled and rearwardly tapering rubber buffer 25, which in this case is also designed to be adjustable to the extent where it can be adjusted between at least two positions, namely between the position illustrated here, where a hard tip 24 is arranged so as to pass through a hole in the rubber buffer 25, which is suitable for icy underlying surfaces or gravel, but it is possible for the buffer, when an adjusting lever 26 is tilted down to the right, to be displaced downward and, by the adjusting lever 26 being swung up again, to be fixed there, so that, in this position, the tip 24 to some extent disappears in the opening in the buffer 25 and therefore all that then comes into contact with the ground is the rolling surface of the asymmetric buffer. In other words, this is a tip as is known, for example, from WO 2008/037098.

At the upper end, the lowermost tube portion 9 likewise has a plug-fit connection 17 which is formed essentially identical to that in the case already described, i.e. there is a guide stub 49 which tapers conically 18 at its tip and has an external diameter such that it can be pushed into the lower end of the lower central tube portion 8'.

The conically tapering region 18 here, in this case too, is designed in the form of a slotted conical terminating stub which is screwed into the cylindrical region of the plug-fit connection 17. For this purpose, the conical terminating stub 18, in the region which engages in the cylindrical region of the plug-fit connection 17, has an external thread, and the cylindrical region of the plug-fit connection 17, on the inner side there, has a corresponding internal thread. In order to facilitate screwing-in and unscrewing, the conical terminating stub 18, in the exposed, conically tapering region, has two axially oppositely located notches 18', of which the axially running flanks run parallel, so that a tool can be used to unscrew the conically terminating stub 18.

The individual tube portions here are connected via a flexible but stretch-resistant pull cable 16, which is made up, for example, of stretch-resistant plastics fibers, e.g. ultra-high-molecular-weight polyethylene (=UHMWPE or high-modulus polyethylene=HMPE, e.g. Dyneema®), meta-aramid or para-aramid (e.g. Kevlar®) or the like, being monofilament and/or braided and/or sheathed. It is likewise possible to have a possibly sheathed wire cable. The pull cable 16 preferably has a thickness of 0.25-6 mm, preferably 0.4-3 mm, in particular preferably 0.5-2 mm. For ensuring the tensile strength of the pull cable, it is preferred to use, for example, multifilaments made up of a plurality of parallel monofilaments, e.g. made of ultra-high-molecular-weight polyethylene (=UHMWPE or high-modulus polyethylene=HMPE), possibly encapsulated in a carrier material, or multifilaments made up of a plurality of braided monofilaments, e.g. made of ultra-high-molecular-weight polyethylene (=UHMWPE or high-modulus polyethylene=HMPE), possibly encapsulated in a carrier material individually and/or in the form of a braiding. Chain-like pull cables are also possible. By means of the latter, the individual tube portions 8' and 9 along with the two upper tube portions 7, 8 pushed one inside the other are connected loosely in this position, which is advantageous for transporting purposes and prevents the individual parts from getting lost. Certain portions of the pull cable 16, in particular the portions provided for folding, can be provided with a protective sheathing, preferably in the form of a PVC hose. The pull cable is preferably a flexible but stretch-resistant one with a thickness ranging from 0.5 to 1.5 mm, e.g. made up of braided UHMWPE fibers obtained by gel spinning, encapsulated or provided with a coating from a thermoplastic material.

FIG. 2 shows an axial section through said pole when it is in the fitted-together state, i.e. when the two lower tube portions 8' and 9 have been fitted one inside the other and the two upper tube portions 7, 8 are extended as far apart as possible from one another. The pole can be transferred from the collapsed position, as illustrated in FIG. 1, to the fitted-together position according to FIG. 2 by the lowermost pole-tube portion 9 being pushed, via the plug-fit connection 17, into the lower of the two central tube portions 8', by the central portion 8' then (or beforehand) being pushed into the other central portion 8 via the corresponding plug-fit connection 17, and by the external clamping mechanism 10 then being released by the lever 11 being released, and the tube 8 then being extended out of the tube 7. This is done until the state is reached in which the pull cable 16, as is illustrated in FIG. 2*a*, is braced, because a pull cable 16 is fastened on the inside of the lowermost tube portion 9 and of the uppermost tube portion 7. In this position, the pole is then fixed by the external clamping mechanism 10 being secured again. The plug-fit connections between the tube portions 8, 8' and 8' and 9, and which per se provide fixing only in one axial direction, are thereby also fixed in the other axial direction and are stable.

Figure 4C:
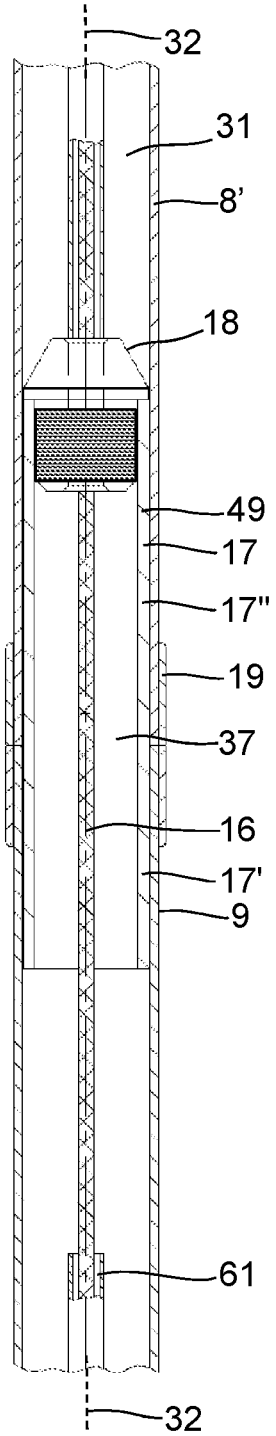
Figure 6B:
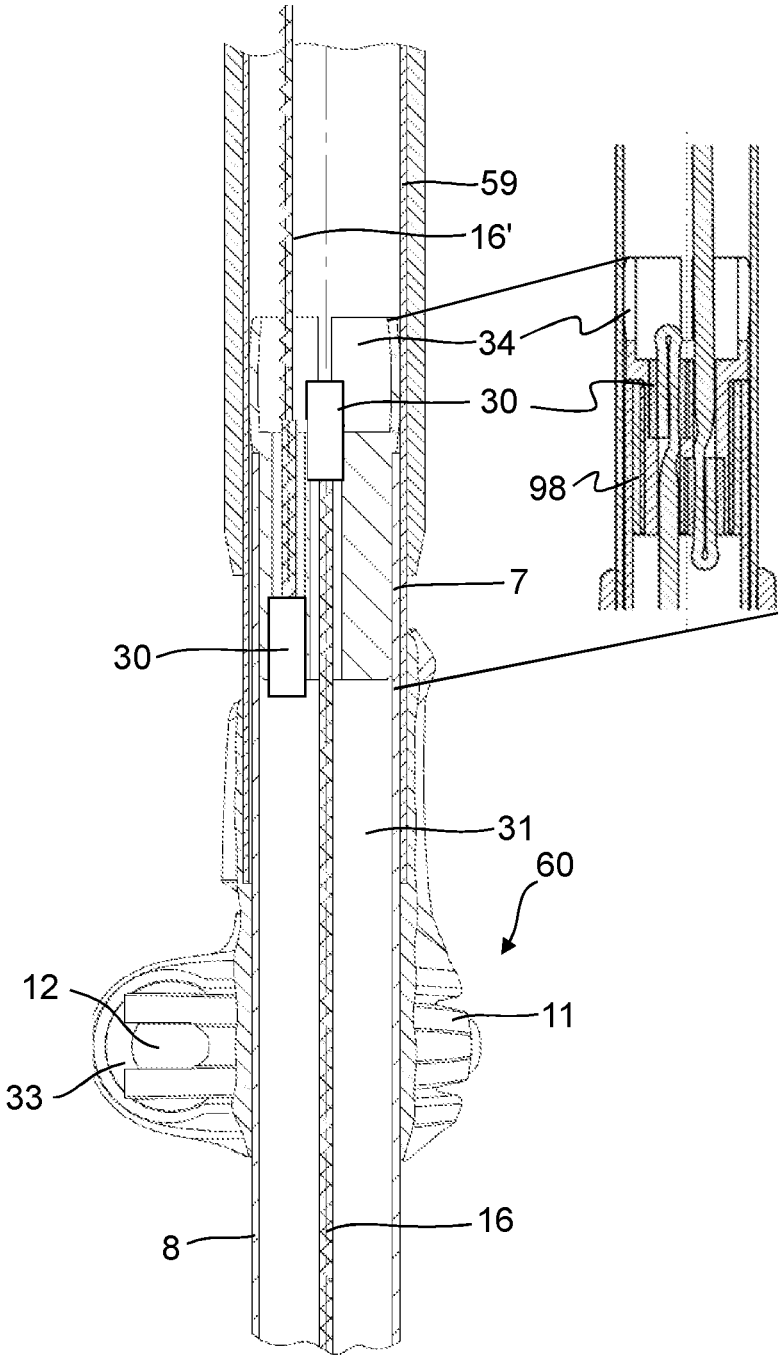
Figure 6C:
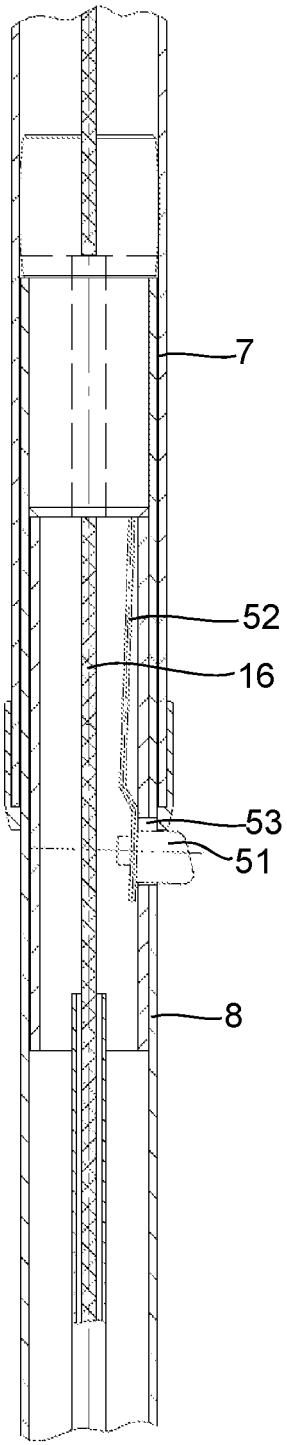
Figure 6D:
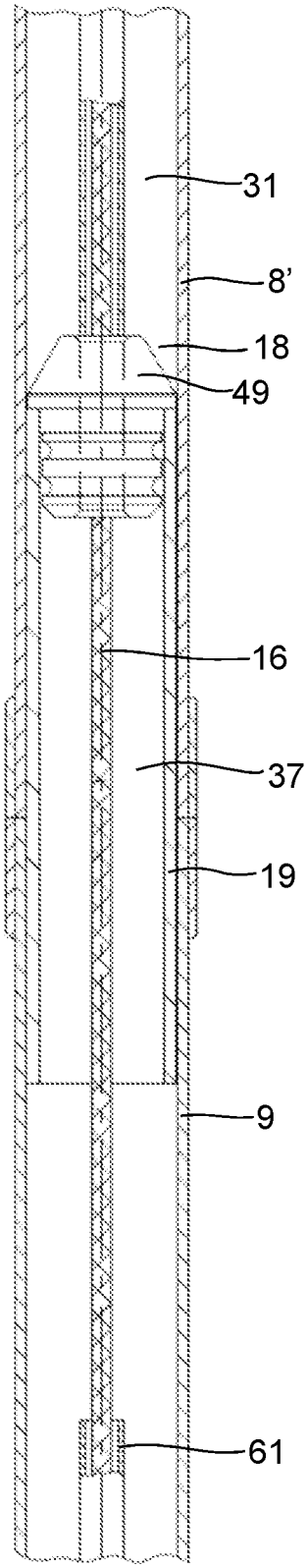

FIGS. 4*b* and 6*c* illustrate alternative exemplary embodiments in which the cable bracing is made possible by a form-fitting latching mechanism instead of by the external clamping mechanism 10. The clamping mechanism illustrated in FIG. 6*b* is analogous to that illustrated in FIG. 2, but performs the function of adjusting the length of the upper part of the second tube portion 8'. The upper attachment point for the pull cable is illustrated here. The pull cable is crimped at its upper end and the crimp 30 prevents the pull cable from passing through the through-opening 35 of the terminating stub 34. Via the further pull cable 16', the tube portion 8, which adjoins the additional tube portion 59, is connected to the handle head or a cable which is fastened, as a fastening element, between the upper end of the additional tube portion and the handle. The length of this further pull cable 16' is set such that the tube portion 8 can be extended downwardly out of the additional tube portion 79 only precisely to the extent where it is still thus sufficiently guided in the latter. This ensures that the tube portion 8 is always fitted into the additional tube portion 79 to a sufficient extent, and the two tube portions cannot be separated.

The detail which is presented as an insert to the right of FIG. 6*b* illustrates how the terminating stub 34 can be screwed, by way of its external thread, in a threaded sleeve, for example made of metal, which is adhesively bonded in a plastic ring fastened in the tube portion 7.

Figure 7A:
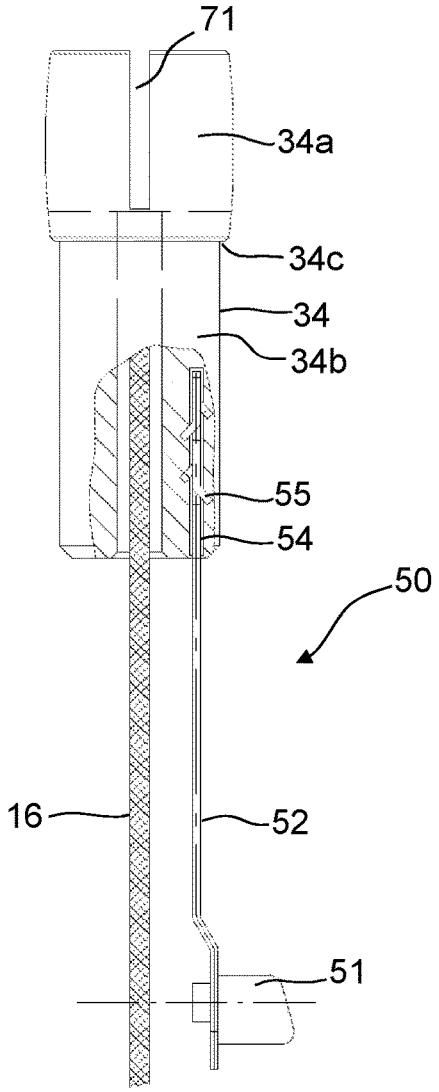
FIGS. 7*a*-7*d* show, in FIG. 7*a*), a partial axial section through a terminating stub according to FIGS. 4*b*) and 6*c*) and, in FIG. 7*b*), a terminating stub for an external form-fitting mechanism and, in FIG. 7*c*), the uppermost, unscrewable part of the terminating stub according to FIG. 7*b*) and, in FIG. 7*d*), an axial section taken along O-O in FIG. 7*c*)

The terminating stub 34 also has, as illustrated in FIG. 7*a*, a channel 54, in which the upper end of a leaf spring 52 projects and in which the leaf spring 52 is fastened with self-locking action, in this case with the aid of barbs 55. A latching pin 51 is fastened, e.g. riveted, at the lower end of the leaf spring 52. If pressure is applied to the latching pin in order to release the latching mechanism in the radial direction, then the leaf spring is braced and at least part of the latching pin 51 enters into the interior space 31 of the pole tube through the through-opening 35.

Figure 7B:
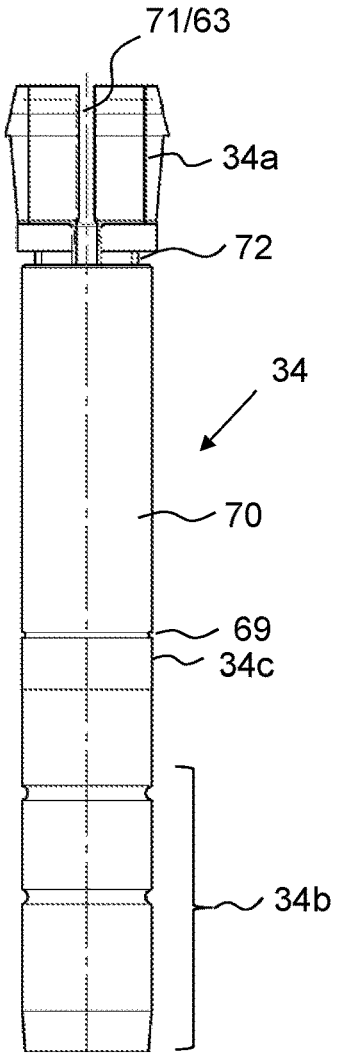
Figure 7C:
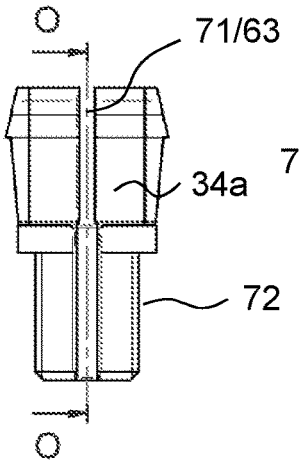
Figure 7D:
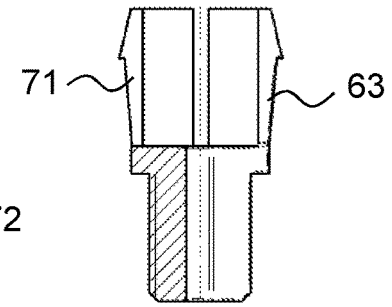

According to a further preferred embodiment, the terminating stub 34 can also be designed for a clamping mechanism according to WO 2012/104424, i.e. for an external form-fitting clamping mechanism with a spring-mounted rocker (cf. FIGS. 7*b* and 7*c*). The tip of this rocker engages from the outside, for the form fit, in the encircling groove 69 which is provided in said terminating stub 34. The terminating stub 34 has a lower region 34*b*, by means of which it is fastened, preferably adhesively bonded or firmly clamped, into the tube portion 8. It is pushed into the tube portion 8 up to the collar 34*c*. The encircling groove 69 is followed in the upward direction by an extension region 70 with an external diameter which is essentially the same as that of the tube portion 8. This extension region 70 ensures that the unit made up of the tube portion 8 and said terminating stub 34 is always sufficiently guided in the following tube portion 7.

As described, the terminating stub 34 preferably has a head region 34*a*, which is screwed into the lower region 70/34*b*. Such a head region 34*a*, which typically also has one or more axial slots, has a narrow axial through-opening for the pull cable and, in the region which projects into the lower region of the stub, an external thread 72. The extension region has a corresponding upper region with an internal thread, and the lower region of the terminating stub 34 has a continuous axial through-opening of large diameter. If the tube portion 8 is to be separated from the pull cable, it is correspondingly possible, as described above, once the lower two tube portions have been separated off, for the head region 34*a* to be unscrewed, and then for the pull cable to be pulled upward through the tube portion 8 and, therefore, for this latter tube portion also to be separated off.

It is also the case in the two alternative exemplary embodiments of FIGS. 4*b* and 6*c* that the second tube portion 8 has a respective terminating stub 34, which has an axial through-opening 35 for the pull cable. The head 34*a* of the terminating stub 34 here, with the pole in the assembled state, has been introduced into the first tube portion 7, which adjoins the second tube portion 8 at the top, while the collar 34*c* rests on the upper end of the second tube portion 8 and projects, by way of the neck portion 34*b*, into the upper end of the second tube portion 8. As mentioned, the head 34*a* is preferably designed in the form of a separate component and can be inserted, preferably screwed, into the lower part of the terminating stub 34. FIG. 7*b* shows the terminating stub 34 in a position in which it has been unscrewed to some extent, so that the external thread 72 is visible. The neck portion 34*b* stops against the upper end of an optional insert element 62, which is fixed in the second tube portion 8, or directly in the tube portion. The insert element 62 bears, by way of its outer wall, against the inner wall of the second tube portion 8 and has a through-bore 53, which is in alignment, or coincides, with that of the second tube portion 8, so that the latching pin 51 can project outward, through this through-bore 53, from the interior space 31 of the pole tube.

The poles according to the exemplary embodiment illustrated in FIGS. 3 and 4*a*, and also 5 and 6*a*, have an ergonomically shaped pole handle 2, of which the handle head 57 has a cover 58, which can be opened or removed. If this cover 58 is opened or removed, then the above-described crimp 30 or the upper end of the pull cable 16 is accessible through the cavity in the handle head 58, or also the cable fastening (described hereinbelow) of the further pull cable 16', which, in particular in combination with the configuration of the lower cable-attachment means described below, makes it possible for the pull cable to be changed over in the event of wear.

The plug-fit connection 17 is formed in two parts. The stub region 49, which has a head portion with a conically tapering region 18 in the form of the conical terminating stub, designed as a separate component, projects here, by way of a neck portion, into the upper portion of the fastening portion. It is possible here for the stub region 49 to be configured, for example, from plastic and for the fastening portion 37 to be configured from aluminum or composite materials. In the exemplary embodiment illustrated in FIGS.

Figure 4D:
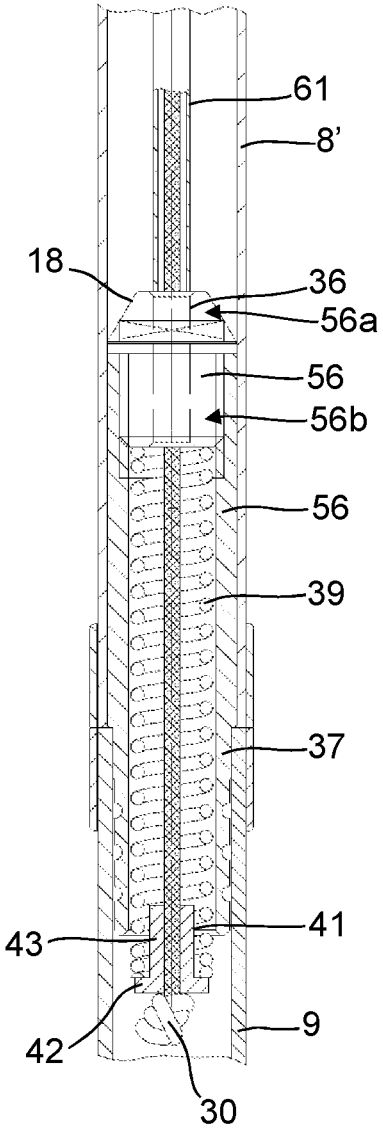
Figure 6E:
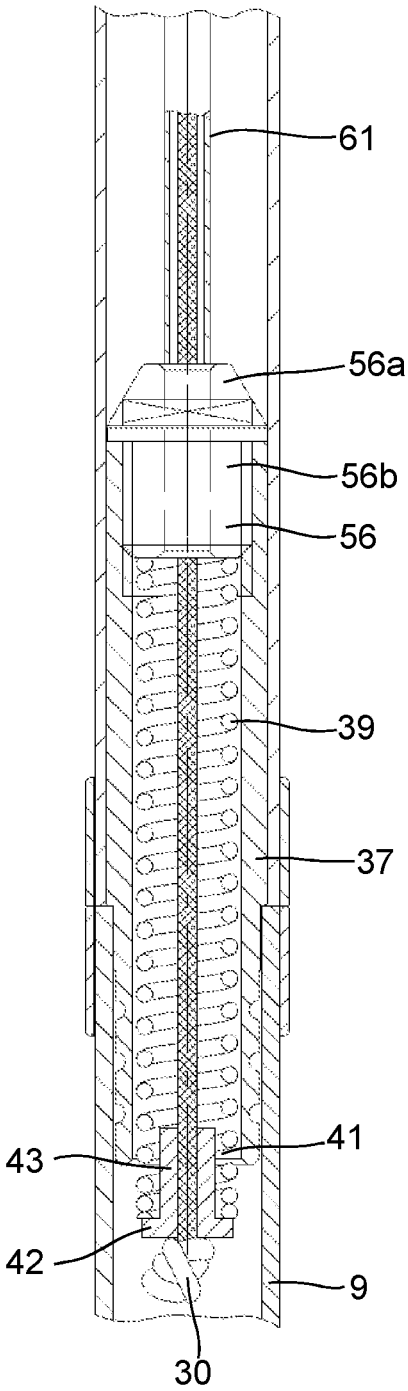

4*c* and 6*d*, the plug-fit connection 17 has no encircling flange 21 between the stub region 49 and fastening portion 37, so that the two tube portions 8' and 9 bear against one another without any offsetting. The region where the two tube portions bear against one another is enclosed here by a tube-terminating cuff 19. In the exemplary embodiments illustrated in FIGS. 4*d* and 6*e*, the plug-fit connection 17 is formed in two parts from a holder element 37 and a closure element 56, the conical terminating stub 18. The closure element 56 here, which has an externally threaded bore in the neck portion 56*b*, has been screwed into the upper end of the holder element 37, which has an internally threaded bore. As an alternative, it is also possible for the connections for the closure element or the conical terminating stub (and also on the other elements) to be realized by other types of connection which can be readily released in a non-destructive manner, e.g. bayonet closure or latching elements, or also by releasable joining techniques. It is possible here for the closure element, in a manner analogous to the stub region 49 of the plug-fit connection or of the guide stub 17, to be formed between the tube portions 8' and 9. Although not illustrated in FIGS. 4*d* and 6*e*, an upper stop element 40 is advantageously arranged between the closure element 56 and helical spring. The holder element 37 here has an upper region with an internally threaded bore, a central region with a shoulder for bearing on the upper end of the lower tube portion 9, and also a lower region, by means of which the plug-fit connection is effectively held in the upper end of the lower tube portion.

Figure 8A:
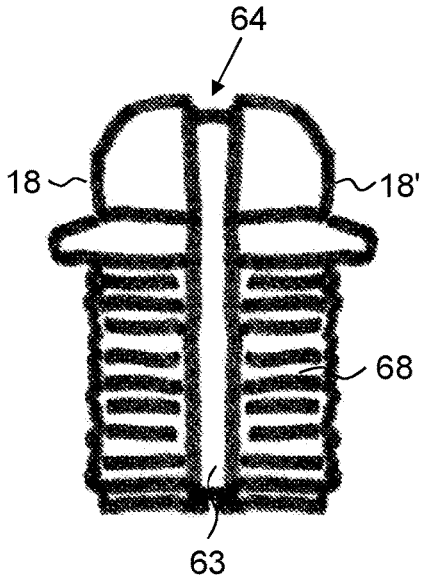
FIGS. 8*a*-8*c* show, in FIG. 8*a*), a conical terminating stub in a lateral view of the axial slot and, in FIG. 8*b*), a conical terminating stub in a lateral view, taken transversely in relation to the view according to FIG. 8*a*), of one of the notches and, in FIG. 8*c*), a plan view of the conical terminating stub.
Figure 8B:
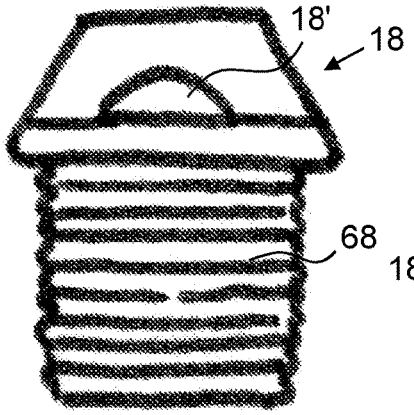
Figure 8C:
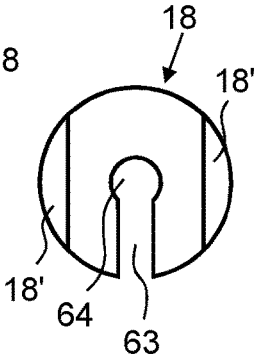

In FIGS. 8*a*-8*c*, then, the specifically configured conical terminating stub, which is used for the two plug-fit connections between the lower three tube portions 8, 8', 9 is installed. This conical terminating stub 18 has an axial through-opening 64 for the pull cable 16. It also has an external thread 68 in the region which projects into the stub region 49. Furthermore, it has a single axial slot 63, which runs over the entire length and allows the conical terminating stub 18 to be separated from the pull cable without any crimps or the like of the pull cable having to be released. This is because the pull cable is preferably fastened in the respective elements by way of crimps, since it is only this which ensures that the corresponding fastening has an actually long-lasting retaining action. Correspondingly, it is considerably advantageous if, rather than just being capable of being unscrewed and screwed in again, the conical terminating stubs can also be separated from the pull cable with the aid of the slot.

Figure 9A:
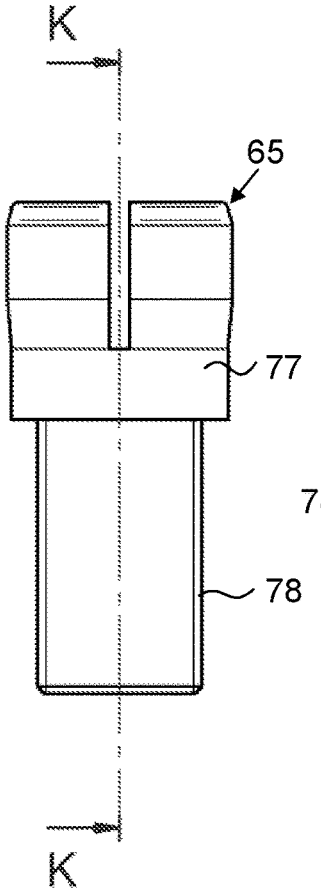
FIGS. 9*a*-9*b* show, in FIG. 9*a*), a side view of the uppermost terminating stub and, in FIG. 9*b*), the uppermost terminating stub in a schematic central section, taken along K-K in FIG. 9*a*), through the two through-openings for the pull cable and the further pull cable.
Figure 9B:
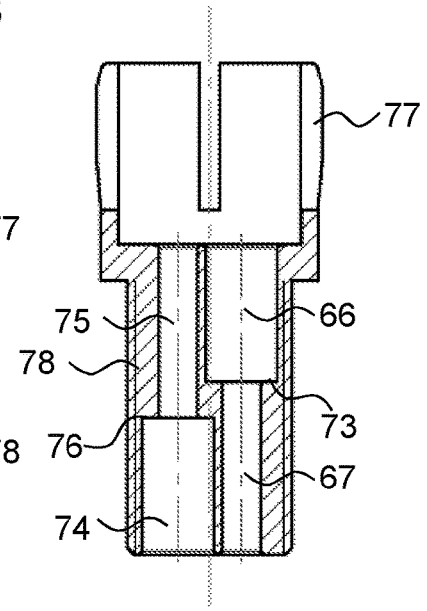

The conical terminating stub additionally has two lateral notches 18', which are provided in the conical region which projects out of the stub region 49. These notches 18' have axially running flanks, which are located parallel, so that the conical terminating stub 18 can be readily gripped, and unscrewed or screwed in, using an open-end wrench or a similar tool. FIGS. 9*a* and 9*b* illustrate the uppermost terminating stub 65. The latter has a head region 77, which projects beyond the uppermost tube portion 7, and a neck region 78, which is firmly fixed in the uppermost tube portion 7. A stepped through-opening 66 for the pull cable 16 is provided in this uppermost terminating stub 65. The stepped through-opening has a narrow region 67, through which the pull cable can be guided, and a further region, which is arranged to follow the step 73. This makes it possible for the pull cable to be fastened in said upper terminating stub 65 by way of a crimp, which then ends up located in this further region, but also, when the bracing of the pull cable is relaxed, to be pulled upward out of the stub. In addition, there is a second through-opening 74 for the further pull cable 16', said second through-opening being stepped pretty much in the other direction. This further pull cable is to be braced in the upward direction, and it is correspondingly possible here for the crimp 30 to butt against the step 76 and for the further pull cable 16' to run through the tapering 75.

Figure 10A:
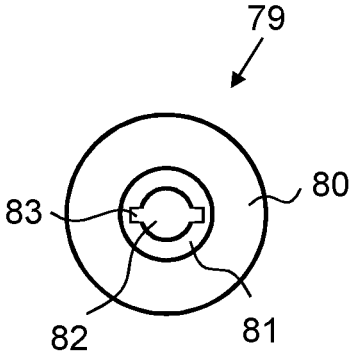
FIGS. 10*a*-10*d* show, in FIG. 10*a*), the cable-fastening element from above and, in FIG. 10*b*), a side view of the cable-fastening element and, in FIG. 10*c*), the upper fastening elements of the further pull cable and, in FIG. 10*d*), a view into a handle head which has been opened by removal of the cover, the view showing the floor of the cavity and the fixing stub.
Figure 10B:
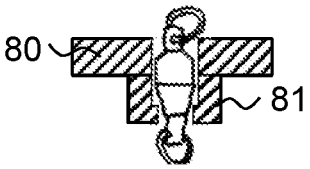
Figure 10C:
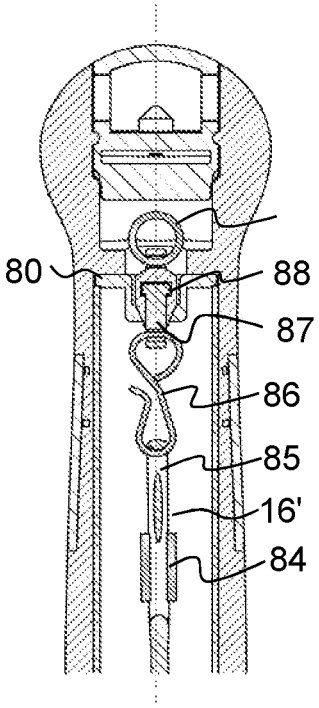
Figure 10D:
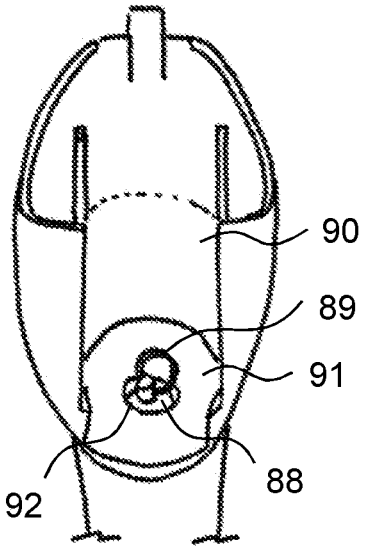

Right at the top, the further pull cable 16' is fastened by a cable-fastening element, as is illustrated in FIGS. 10*a* and 10*b*. The fastening element 79 has a plate region, which is positioned on the additional tube portion 59 or can be fastened therein right at the top. For this purpose, the set-back region 81 engages, for example, in the upper cavity of the additional tube portion 59. A through-opening 82 for the further pull cable 16' is provided in the region 81. So that it is possible for hooks 86, which are possibly provided on this pull cable, to be guided through the cable-fastening element 79, it is possible for a lateral widening 83 to be present in the through-opening. The fastening element then abuts the lower region of the floor 91 of the handle, which is illustrated from above in FIG. 10*d*, once the cover has been removed. The pull cable is fastened at the top such that it forms an upper loop 85, and the loop is secured by a crimp 84. This loop 85 is gripped by a hook 86, which is mounted in a rotatable stub 87 in the actual bearing element 88. The rotation capability is advantageous since it is then possible for the pull cable to not rotate while the tubes rotate in relation to one another. The bearing element 88 tapers conically downward and has a retaining ring 89 at the top. The bearing element 88 rests, by way of its conically downwardly tapering region, either on a step in the through-opening 92 in the floor 91 of the cavity 90 of the handle head or on the cable-fastening element 79.

It is then also possible for the further pull cable 16' to be readily released by the additional tube portion 79 and the uppermost tube portion 7 being pushed as far as possible one inside the other by virtue of the outer clamping being released, the bracing of the further pull cable 16' being relaxed as a result, and it is then possible for the bearing element to be pulled upward out of the handle head by at the retaining ring 89, for the hook 86 to be separated from the loop 85, and then for the uppermost tube portion 7 to be pulled downward out of the additional tube portion 79.

Along with the slotted conical terminating stub and the terminating stub 34, in the case of which the head region 34*a* can be unscrewed, it is thus possible for the folding pole to be non-destructively taken apart and assembled again, and for parts to be changed over, renewed or otherwise altered.

Figure 11:
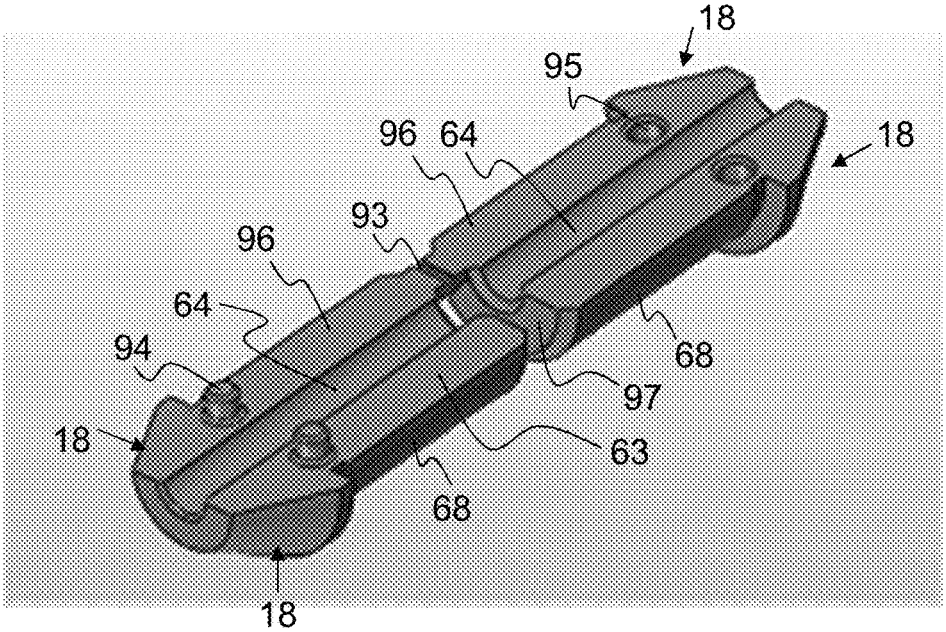
FIG. 11 shows a conical terminating stub having two halves connected via a film hinge.

FIG. 11 shows a conical terminating stub 18 which consists of two conical-terminating-stub halves 96. The two halves are connected in one piece via a film hinge 93. The conical-terminating-stub halves 96 are of essentially symmetrical design and are separated via a central axial imaginary separating surface. If the two halves 96 are swung onto one another around the film hinge 93, then the axial through-opening 64 forms and the slot 63 is created by a spacing between the abutment surfaces. If the conical terminating stub 18 has been screwed into the stub region via the external thread 68, the slot 63 is closed as a result of abutment of the contact surfaces. In order to ensure that the two halves are positioned as exactly as possible relative to one another, which is important in particular on account of the external thread 68, it is possible, as illustrated here, for positioning stubs 94 and corresponding positioning recesses 95 (in the form of blind holes), which can also be designed in the form of a latching connection, to be provided in the contact surfaces. Other form-fitting and/or force-fitting connections are also possible, but they have to be releasable.

The film hinge 93 here is arranged on the axial end surface 97 only on one side, i.e. only on one side of the through-opening 64, which is formed in the fitted-together state, so that the axial slot 63 is only just freed and the pull cable can be inserted.

Figure 12:
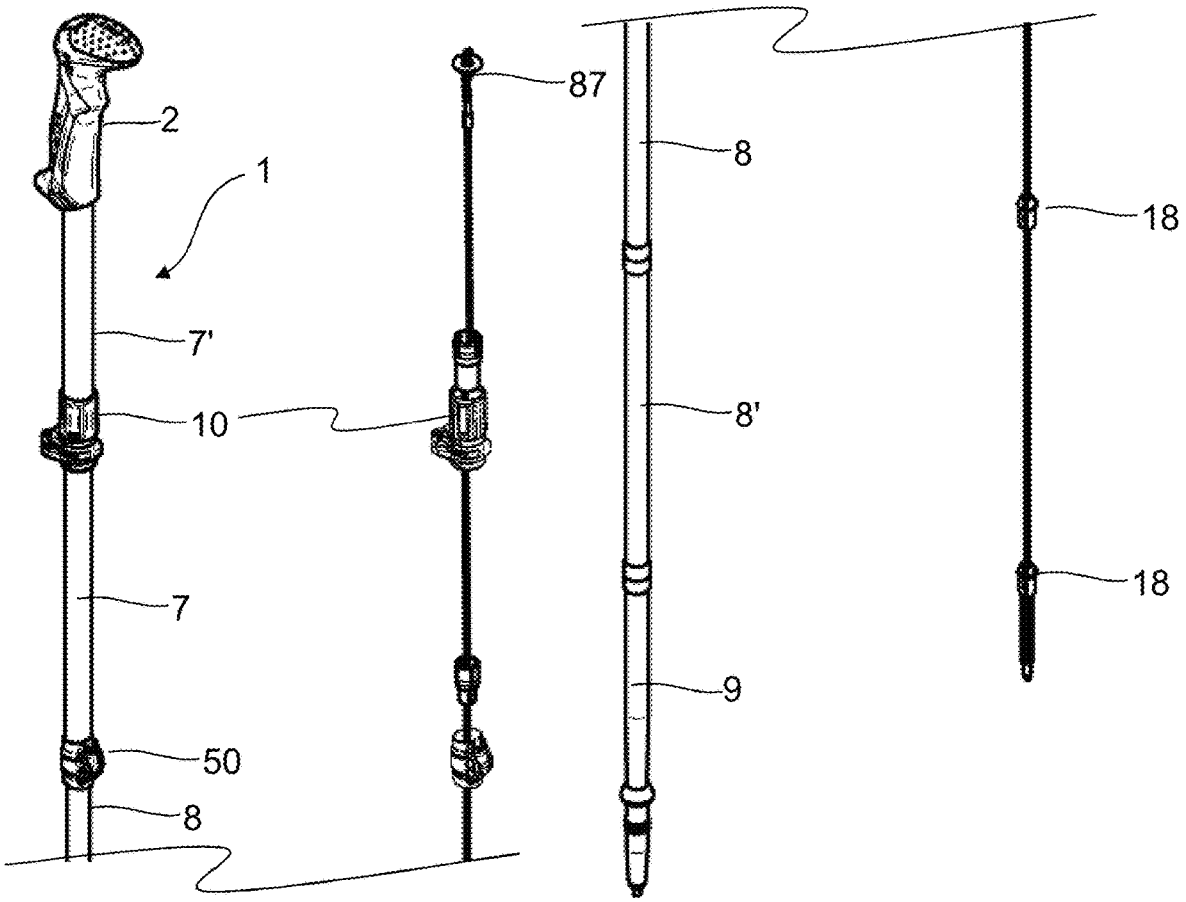
FIG. 12 shows a view of a further embodiment of a pole in the fitted-together state, wherein, for cable-bracing purposes, the pole has an external clamping mechanism at the top and, beneath this, a form-fitting latching device, and wherein in each case the left-hand side gives an illustration of the fitted-together pole and the right-hand side gives an illustration of the design without tubes, to expose the clamping mechanisms and the pull cable, etc.

FIG. 12 shows a further exemplary embodiment of such a pole which has five tube portions, wherein the lowermost two connections between the portions 9 and 8' and also 8' and 8 are designed in the form of straightforward plug-fit connections with corresponding conical terminating stubs 18. It can also be the case that just one such plug-fit connection is provided for this embodiment, i.e. it is also possible for this embodiment to be designed with four tube portions, i.e. the portion 8', which is illustrated here, would not be present in that case. Here, then, an external latching connection is provided between the tube portion 8 and the further tube portion 7, arranged above, and then an external clamping mechanism is provided between the uppermost tube portion 7' and said further tube portion 7. The pull cable runs, in the form of a single pull cable, through this entire structure and is fastened on the lowermost tube portion 9 and on the uppermost tube portion 7'.

LIST OF REFERENCE SIGNS

1 folding pole
2 pole handle
3 retaining nose
4 slot
5 trigger button
6 grip region of 2
7 first tube portion
7' uppermost tube portion, additional tube portion
8 second tube portion
8' further central tube portion
9 lower tube portion
10 external clamping mechanism
11 clamping lever
12 axial clamping element
13 encircling retaining region of 10
14 slotted clamping region of 10
15 upper tube-terminating cuff
16 pull cable
16' further pull cable between the first tube portion and additional tube portion
17 guide stub or plug-fit connection
17' fastening region of 17 in the respectively lower tube with through-opening
17" stub region with through-opening
18 conically tapering region of 17, conical terminating stub
18' notch, step, shoulder, milled recess
19 lower tube-terminating cuff
20 abutment surface of 19 on 21
21 bearing flange of lower holder of 17
22 abutment surface of 21 on 19
23 pole tip
24 tip element
25 rubber buffer
26 adjusting lever
27 holder element or upper fastening stub for 16
28 central through-opening in 27 for 16
29 widened region of 28 in the upper portion of 27
30 crimp on 16
31 interior space in the tube
32 pole axis
33 shim
34 terminating stub
34*a* head region of 34
34*b* neck region of 34, region for fitting into tube portion
34*c* collar of 34
35 axial through-opening for 16 in 34
36 axial through-opening for 16 in 17
37 holder element or fastening portion
38 widening of 36 for 39
39 helical spring
40 guide element or stop element for 39
41 guide element or terminating element for 39
42 radial flange of 40/41
43 axial guide portion of 40/41
44 engagement portion of 19
45 radially external axial ribs on 44
46 radially external axial grooves on 44
47 radially internal axial grooves on inner side of 21
48 radially internal axial ribs on inner side of 21
49 stub region of 17
50 latching device
51 latching pin
52 spring element
53 radial through-bore in 8 and 62
54 axial channel in 34
55 retaining means of 52
56 closure element
56*a* head portion of 56
56*b* neck portion of 56
56*c* axial through-opening of 56
57 handle head
58 cover of 57
59 additional tube portion, uppermost tube portion
60 external clamping mechanism for length-adjustment purposes
61 protective sheathing
62 insert element
63 axially running slot in 18
64 axial through-opening in 18
65 uppermost terminating stub
66 stepped through-opening in 65 for pull cable
67 tapering in 66
68 external thread of 18
69 encircling groove in 70 of 34
70 extension region of 34
71 slot in 34*a*
72 external thread of stub of 34*a*
73 step in 66
74 stepped through-opening in 65 for further pull cable in the upward direction
75 tapering in 66
76 step in 74
77 head region of 65
78 neck region of 65, region for fitting into tube portion
79 cable-fastening element for the additional tube portion beneath the floor in the cavity of the handle head
80 plate region of 79
81 set-back region of 79
82 through-opening for further pull cable 16'
83 widenings/axial grooves for fastening the further pull cable
84 crimp for upper loop of the further pull cable 16'
85 upper loop of the further pull cable
86 hook for fastening of 85
87 rotatable stub
88 bearing element
89 retaining ring of 88

90 cavity in the handle head
91 floor of 90
92 through-opening in 91
93 film hinge
94 positioning stub
95 positioning recesses
96 conical-terminating-stub half
97 axial end surface
98 internally threaded sleeve adhesively bonded in place

The invention claimed is:

1. A folding pole comprising:

at least three tube portions that are configured to:

in an assembled state of the folding pole, be connected to one another so as to be oriented along an axis of the folding pole via plug-fit connections; and in a collapsed state of the folding pole, have at least two from among the at least three tube portions connected to one another via a movable connecting element, wherein a pole handle is arranged on an uppermost tube portion from among the at least three tube portions, and a pole tip is arranged on a lowermost tube portion from among the at least three tube portions, wherein at least one of the plug-fit connections is an external clamping mechanism or a form-fitting latching device, wherein the external clamping mechanism is fastened on a first tube portion from among the at least three tube portions, and the external clamping mechanism is configured to fix a second tube portion from among the at least three tube portions in an axial position relative to the first tube portion, and wherein the form-fitting latching device is on the second tube portion and configured to fix the second tube portion in the axial position relative to the first tube portion in a state where the second tube portion is pushed into the first tube portion, wherein the second tube portion has an external diameter that is smaller than or equal to an internal diameter of the first tube portion, and the second tube portion is configured to be mountable in a displaceable manner in the first tube portion, wherein at least one additional plug-fit connection from among the plug-fit connections is a plug-fit connection that is configured to fix together, in one axial direction, at least two of the at least three tube portions in the assembled state, wherein the at least three tube portions are connected to one another by at least one pull cable, which is fastened on two tube portions among the at least three tube portions including the lowermost tube portion, and the at least one pull cable runs through an interior space of at least one intermediate tube portion among the at least three tube portions, wherein the folding pole is configured to be transferred from the collapsed state to the assembled state by the at least one additional plug-fit connection being fitted together and then, with the external clamping mechanism or the form-fitting latching device released:

by the second tube portion being pulled out of the first tube portion until a pull cable, from among the at least one pull cable, is braced, and by fixing the external clamping mechanism or the form-fitting latching device, wherein at least one from among the at least one additional plug-fit connection comprises, on one tube portion from among the at least three tube portions, a guide stub, wherein the guide stub is firmly fastened in the one tube portion by a fastening portion and the guide stub comprises, axially opposite to the fastening portion, a stub region that is exposed in a case where the folding pole is in the collapsed state and that is configured to be pushed into another one of the at least three tube portions, wherein the fastening portion and the stub region include an axial through-opening for the pull cable, wherein a conical terminating stub with an axial through-opening is inserted in a releasable manner into the stub region so as to close the stub region off in relation to the another one of the at least three tube portions, and wherein the conical terminating stub includes an axial slot that is configured to introduce the pull cable into the axial through-opening of the conical terminating stub in a radial direction, and wherein the conical terminating stub comprises a conically tapering region which is exposed when the folding pole is in the collapsed state, and the conically tapering region includes means via which the conical terminating stub can be gripped and screwed in or unscrewed and/or latched in or unlatched.

2. The folding pole as claimed in claim 1, wherein the at least three tube portions is at least four tube portions, wherein the at least four tube portions are configured to, in the collapsed state of the folding pole, have at least three from among the at least four tube portions connected to one another via the movable connecting element, wherein the at least one additional plug-fit connection is configured to connect together the at least three from among the at least four tube portions, and wherein the least one additional plug-fit connection is at least two additional plug-fit connections that each comprise the guide stub and the conical terminating stub.

3. The folding pole as claimed in claim 1, wherein the means of the conically tapering region comprises two oppositely located notches, which have mutually parallel surfaces forming planes at a tangent to the axis of the folding pole, and wherein the mutually parallel surfaces extend in a same direction as an extending direction of the axial slot.

4. The folding pole as claimed in claim 1, wherein at least two lowermost tube portions, among the at least three tube portions, are configured to be connected to one another by the at least one additional plug-fit connection, wherein a subsequent tube portion, with respect to the at least two lowermost tube portions, from among the at least three tube portions, or the uppermost tube portion comprises, at an upper end thereof, a terminating stub that comprises:

a head region that projects upward out of the subsequent tube portion or the uppermost tube portion; and a neck region that is configured to firmly fasten the terminating stub to the subsequent tube portion or the uppermost tube portion, and wherein the head region and the neck region are separate components from one another that are configured to be inserted in a releasable manner, one inside the other.

5. The folding pole as claimed in claim 4, wherein the first tube portion is the uppermost tube portion or a second-from-top tube portion, and wherein the second tube portion is a first intermediate tube portion, which adjoins the first tube portion in a downward direction, wherein the at least one of the plug-fit connections is the form-fitting latching device, wherein the form-fitting latching device comprises a spring-loaded radial latching pin, which is retained in a radial through-bore of the second tube portion so as to project through the radial through-bore counter to action of a spring element or which engages in a groove in the terminating stub from an outside, and wherein the at least one intermediate tube portion comprises two intermediate tube portions, including the second tube portion, and wherein the lowermost tube portion and the two intermediate tube portions are connected to one another via the at least one additional plug-fit connection.

6. The folding pole as claimed in claim 1, wherein the pull cable is elastically fastened to a holder element.

7. The folding pole as claimed in claim 1, wherein the pull cable comprises a flexible, longitudinally tension-resistant and non-elastic material which is provided with a plastic coating or is encapsulated in a plastic.

8. The folding pole as claimed in claim 1, wherein the first tube portion is the uppermost tube portion or a second-from-top tube portion, and wherein the second tube portion is a first intermediate tube portion, which adjoins the first tube portion in a downward direction, and wherein the at least one of the plug-fit connections is the form-fitting latching device.

9. The folding pole as claimed in claim 1, wherein the at least three tube portions are dimensioned such that, when the folding pole is in the assembled state, an uppermost intermediate tube portion, among the at least three tube portions, can be pushed essentially all the way into the uppermost tube portion.

10. The folding pole as claimed in claim 1, wherein the pull cable is fastened on the lowermost tube portion or on the uppermost tube portion by a holder element, and where the holder element is fixed axially in the lowermost tube portion or the uppermost tube portion, and the pull cable is fastened to the holder element.

11. The folding pole as claimed in claim 1, wherein an outwardly directed bearing flange is between the fastening portion and the stub region, and wherein, in the assembled state, the outwardly directed bearing flange is configured to stop axially against a tube end of another tube portion, from among the at least three tube portions, or against a tube-terminating cuff-provided on the tube end.

12. The folding pole as claimed in claim 1, further comprising a length-adjustment mechanism.

13. The folding pole as claimed in claim 1, wherein the conical terminating stub is formed in one piece, wherein the one piece is:

a rigid component including a first axial slot having a predefined width, and wherein the pull cable is configured to be introduced, through the first axial slot, into the axial through-opening in the radial direction; or a first flexible component including a second axial slot having a variable width, wherein the second axial slot is configured to introduce the pull cable into the axial through-opening in the radial direction; or a second flexible component including two conical-terminating-stub halves connected by a film hinge, wherein the film hinge connects the two conical-terminating-stub halves only on one side of the axial through-opening.

14. The folding pole as claimed in claim 1, wherein the at least three tube portions is at least four tube portions, wherein the at least four tube portions are configured to, in the collapsed state of the folding pole, have at least three from among the at least four tube portions connected to one another via the movable connecting element, wherein the at least one additional plug-fit connection is configured to connect together the at least three from among the at least four tube portions, and wherein the least one additional plug-fit connection is at least two additional plug-fit connections that each comprise the guide stub and the conical termination stub.

15. The folding pole as claimed in claim 1, wherein the first tube portion comprises an uppermost terminating stub, and the pull cable is fastened in the uppermost terminating stub in such a manner that, when the pull cable is not braced, the pull cable can be pulled upward out of the uppermost terminating stub through a stepped through-opening of the uppermost terminating stub, and wherein a knot or a crimp of the pull cable is configured to be caught by a step of the stepped through-opening.

16. The folding pole as claimed in claim 1, wherein the at least three tube portions are dimensioned such that, when the folding pole is in the assembled state:

an intermediate tube portion, among the at least three tube portions, can be pushed essentially all the way into an additional tube portion, among the at least three tube portions; and the additional tube portion can be pushed essentially all the way into the uppermost tube portion among the at least three tube portions.

17. The folding pole as claimed in claim 1, wherein a radially encircling, outwardly directed bearing flange is between the fastening portion and the stub region, and wherein, in the assembled state, the radially encircling, outwardly directed bearing flange is configured to stop axially against a tube end of another tube portion, from among the at least three tube portions, or against a tube-terminating cuff provided on the tube end.

18. The folding pole as claimed in claim 1, wherein the at one of the plug-fit connections is the external clamping mechanism, and wherein the external clamping mechanism is also a length-adjustment mechanism that is configured to adjusting a length of the folding pole.

19. A folding pole comprising:

at least three tube portions that are configured to:

in an assembled state of the folding pole, be connected to one another so as to be oriented along an axis of the folding pole via plug-fit connections; and in a collapsed state of the folding pole, have at least two from among the at least three tube portions connected to one another via a movable connecting element, wherein a pole handle is arranged on an uppermost tube portion from among the at least three tube portions, and a pole tip is arranged on a lowermost tube portion from among the at least three tube portions, wherein at least one of the plug-fit connections is an external clamping mechanism or a form-fitting latching device, wherein the external clamping mechanism is fastened on a first tube portion from among the at least three tube portions, and the external clamping mechanism is configured to fix a second tube portion from among the at least three tube portions in an axial position relative to the first tube portion, and wherein the form-fitting latching device is on the second tube portion and configured to fix the second tube portion in the axial position relative to the first tube portion in a state where the second tube portion is pushed into the first tube portion, wherein the second tube portion has an external diameter that is smaller than or equal to an internal diameter of the first tube portion, and the second tube portion is configured to be mountable in a displaceable manner in the first tube portion, wherein at least one additional plug-fit connection from among the plug-fit connections is a straightforward plug-fit connection that is configured to fix together, in one axial direction, at least two tube portions from among the at least three tube portions in the assembled state, wherein the at least three tube portions are connected to one another by at least one pull cable, which is fastened on two tube portions among the at least three tube portions including the lowermost tube portion, and the at least one pull cable runs through an interior space of at least one intermediate tube portion among the at least three tube portions, wherein the folding pole is configured to be transferred from the collapsed state to the assembled state by the at least one additional plug-fit connection being fitted together and then, with the external clamping mechanism or the form-fitting latching device released:

by the second tube portion being pulled out of the first tube portion until a pull cable, from among the at least one pull cable, is braced, and by fixing the external clamping mechanism or the form-fitting latching device, wherein at least one from among the at least one additional plug-fit connection comprises, on one tube portion from among the at least three tube portions, a guide stub, wherein the guide stub is firmly fastened in the one tube portion by a fastening portion and the guide stub comprises, axially opposite to the fastening portion, a stub region that is exposed in a case where the folding pole is in the collapsed state and that is configured to be pushed into another one of the at least three tube portions, wherein the fastening portion and the stub region include an axial through-opening for the pull cable, wherein a conical terminating stub with an axial through-opening is inserted in a releasable manner into the stub region so as to close the stub region off in relation to the another one of the at least three tube portions, and wherein the conical terminating stub includes an axial slot that is configured to introduce the pull cable into the axial through-opening of the conical terminating stub in a radial direction, wherein the first tube portion comprises an uppermost terminating stub, and the pull cable is fastened in the uppermost terminating stub in such a manner that, when the pull cable is not braced, the pull cable can be pulled upward out of the uppermost terminating stub, wherein the at least two tube portions comprises an additional tube portion above the first tube portion, wherein the first tube portion is configured to be pushed into the additional tube portion in a displaceable manner, and secured to the additional tube portion in various positions by a second external clamping mechanism, and wherein the uppermost terminating stub is connected to the additional tube portion by an additional pull cable, from among the at least one pull cable, such that, when the second external clamping mechanism is released, the first tube portion cannot be pulled out of the additional tube portion.

20. The folding pole as claimed in claim 19, wherein the additional pull cable is fastened in a releasable manner, at an upper end of the additional tube portion or on the pole handle.

21. The folding pole as claimed in claim 19, wherein the additional pull cable is fastened in a releasable manner, so as to be free of rotation, at an upper end of the additional tube portion or on the pole handle, and wherein the fastening of the additional pull cable is configured to be released by the fastening of the additional pull cable being freed from an outside in a non-destructive manner.

22. A folding pole comprising:

at least three tube portions that are configured to:

in an assembled state of the folding pole, be connected to one another so as to be oriented along an axis of the folding pole via plug-fit connections; and in a collapsed state of the folding pole, have at least two from among the at least three tube portions connected to one another via a movable connecting element, wherein a pole handle is arranged on an uppermost tube portion from among the at least three tube portions, and a pole tip is arranged on a lowermost tube portion from among the at least three tube portions, wherein at least one of the plug-fit connections is an external clamping mechanism or a form-fitting latching device, wherein the external clamping mechanism is fastened on a first tube portion from among the at least three tube portions, and the external clamping mechanism is configured to fix a second tube portion from among the at least three tube portions in an axial position relative to the first tube portion, and wherein the form-fitting latching device is on the second tube portion and configured to fix the second tube portion in the axial position relative to the first tube portion in a state where the second tube portion is pushed into the first tube portion, wherein the second tube portion has an external diameter that is smaller than or equal to an internal diameter of the first tube portion, and the second tube portion is configured to be mountable in a displaceable manner in the first tube portion, wherein at least one additional plug-fit connection from among the plug-fit connections is a straightforward plug-fit connection that is configured to fix together, in one axial direction, at least two of the at least three tube portions in the assembled state, wherein the at least three tube portions are connected to one another by at least one pull cable, which is fastened on two tube portions among the at least three tube portions including the lowermost tube portion, and the at least one pull cable runs through an interior space of at least one intermediate tube portion among the at least three tube portions, wherein the folding pole is configured to be transferred from the collapsed state to the assembled state by the at least one additional plug-fit connection being fitted together and then, with the external clamping mechanism or the form-fitting latching device released:

by the second tube portion being pulled out of the first tube portion until a pull cable, from among the at least one pull cable, is braced, and by fixing the external clamping mechanism or the form-fitting latching device, wherein at least one from among the at least one additional plug-fit connection comprises, on one tube portion from among the at least three tube portions, a guide stub, wherein the guide stub is firmly fastened in the one tube portion by a fastening portion and the guide stub comprises, axially opposite to the fastening portion, a stub region that is exposed in a case where the folding pole is in the collapsed state and that is configured to be pushed into another one of the at least three tube portions, wherein the fastening portion and the stub region include an axial through-opening for the pull cable, wherein a conical terminating stub with an axial through-opening is inserted in a releasable manner into the stub region so as to close the stub region off in relation to the another one of the at least three tube portions, and wherein the conical terminating stub includes an axial slot that is configured to introduce the pull cable into the axial through-opening in a radial direction, wherein the conical terminating stub comprises a conically tapering region which is exposed when the folding pole is in the collapsed state, and the conically tapering region includes means via which the conical terminating stub can be gripped and screwed in or unscrewed and/or latched in or unlatched, and wherein the means of the conically tapering region comprises two oppositely located notches, which have mutually parallel surfaces forming planes at a tangent to the axis of the folding pole.

23. A folding pole comprising:

at least three tube portions that are configured to:

in an assembled state of the folding pole, be connected to one another so as to be oriented along an axis of the folding pole via plug-fit connections; and in a collapsed state of the folding pole, have at least two from among the at least three tube portions connected to one another via a movable connecting element, and wherein a pole handle is arranged on an uppermost tube portion from among the at least three tube portions, and a pole tip is arranged on a lowermost tube portion from among the at least three tube portions, wherein at least one of the plug-fit connections is an external clamping mechanism or a form-fitting latching device, wherein the external clamping mechanism is fastened on a first tube portion from among the at least three tube portions, and the external clamping mechanism is configured to fix a second tube portion from among the at least three tube portions in an axial position relative to the first tube portion, and wherein the form-fitting latching device is on the second tube portion and configured to fix the second tube portion in the axial position relative to the first tube portion in a state where the second tube portion is pushed into the first tube portion, wherein the second tube portion has an external diameter that is smaller than or equal to an internal diameter of the first tube portion, and the second tube portion is configured to be mountable in a displaceable manner in the first tube portion, wherein at least one additional plug-fit connection from among the plug-fit connections is a straightforward plug-fit connection that is configured to fix together, in one axial direction, at least two of the at least three tube portions in the assembled state, wherein the at least three tube portions are connected to one another by at least one pull cable, which is fastened on two tube portions among the at least three tube portions including the lowermost tube portion, and the at least one pull cable runs through an interior space of at least one intermediate tube portion among the at least three tube portions, wherein the folding pole is configured to be transferred from the collapsed state to the assembled state by the at least one additional plug-fit connection being fitted together and then, with the external clamping mechanism or the form-fitting latching device released:

by the second tube portion being pulled out of the first tube portion until a pull cable, from among the at least one pull cable, is braced, and by fixing the external clamping mechanism or the form-fitting latching device, wherein at least one from among the at least one additional plug-fit connection comprises, on one tube portion from among the at least three tube portions, a guide stub, wherein the guide stub is firmly fastened in the one tube portion by a fastening portion and the guide stub comprises, axially opposite to the fastening portion, a stub region that is exposed in a case where the folding pole is in the collapsed state and that is configured to be pushed into another one of the at least three tube portions, wherein the fastening portion and the stub region include an axial through-opening for the pull cable, wherein a conical terminating stub with an axial through-opening is inserted in a releasable manner into the stub region so as to close the stub region off in relation to the another one of the at least three tube portions, and wherein the conical terminating stub includes an axial slot that is configured to introduce the pull cable into the axial through-opening of the conical terminating stub in a radial direction, wherein at least two lowermost tube portions, among the at least three tube portions, are configured to be connected to one another by the at least one additional plug-fit connection, wherein a subsequent tube portion, with respect to the at least two lowermost tube portions, from among the at least three tube portions, or the uppermost tube portion comprises, at an upper end thereof, a terminating stub that comprises:

a head region that projects upward out of the subsequent tube portion or the uppermost tube portion; and a neck region that is configured to firmly fasten the terminating stub to the subsequent tube portion or the uppermost tube portion, and wherein the head region and the neck region are separate components from one another that are configured to be inserted in a releasable manner, one inside the other, by latching elements or a bayonet closure.

24. The folding pole as claimed in claim 23, wherein the pull cable is elastically fastened to a holder element of the lowermost tube portion by a helical spring on the holder element, wherein the pull cable runs through an interior space of the helical spring, wherein at least portions of the pull cable are tension-resistant and inelastic, and wherein the helical spring has an external diameter such that the helical spring can be pulled through the axial through-opening of the guide stub, minus the conical terminating stub, and through the conical terminating stub, minus the head region.

* * * * *